US010548400B2

(12) United States Patent
Paterson et al.

(10) Patent No.: US 10,548,400 B2
(45) Date of Patent: Feb. 4, 2020

(54) MODULAR SEATING APPARATUS AND CORRESPONDING SYSTEMS AND METHODS

(71) Applicant: Medline Industries, Inc., Mundelein, IL (US)

(72) Inventors: Michael Paterson, Chicago, IL (US); Matt Costello, Chicago, IL (US); Kristian Trendafilov, Mettmann (DE); Luke Westra, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 573 days.

(21) Appl. No.: 14/845,235

(22) Filed: Sep. 3, 2015

(65) Prior Publication Data

US 2016/0278529 A1 Sep. 29, 2016

Related U.S. Application Data

(60) Provisional application No. 62/137,595, filed on Mar. 24, 2015.

(51) Int. Cl.
*A47C 4/02* (2006.01)
*A47K 3/12* (2006.01)
(Continued)

(52) U.S. Cl.
CPC ..... *A47C 4/021* (2013.01); *A47C 1/124* (2013.01); *A47C 4/03* (2013.01); *A47C 5/12* (2013.01);
(Continued)

(58) Field of Classification Search
CPC ..... A47C 1/124; A47C 13/005; A47C 4/02; A47C 4/021; A47C 4/03; A47C 7/42;
(Continued)

(56) References Cited

U.S. PATENT DOCUMENTS 3,528,096 A 9/1970 Moberg
3,855,646 A 12/1974 Glickman
(Continued)

FOREIGN PATENT DOCUMENTS

CA 2737286 9/2012
CA 3007105 6/2017
(Continued)

OTHER PUBLICATIONS

"Briggs Healthcare", Shower Chair; http://www.walmart.com/ip/Mabis-DMI-Shower-Chair-with-Arms-and-Back-Rest/12354572; Unknown publication date but believe to be prior to filing of present application.

(Continued)

*Primary Examiner* — Erin Deery
*Assistant Examiner* — Nicholas A Ros
(74) *Attorney, Agent, or Firm* — Philip H. Burrus, IV

(57) ABSTRACT

A bench (100) includes an upper member (101), a first leg member (103), and a second leg member (102). The first leg member and the second leg member can be selectively attachable to the upper member. The upper member includes a substantially planar portion (104), a first side end portion (105), and a second side end portion (106). The substantially planar portion can define a seat (113) for a user, where the seat defines a seat width (116) and a seat length (117). The first leg member and the second leg member can define a leg member length (120) that is coextensive with seat length and the lengths of the side end portions. The leg members can include an adjustment mechanism (203) to selectively alter a height (207) of the one or both of the first leg member or the second leg member.

20 Claims, 22 Drawing Sheets

(51) Int. Cl.

| | |
|---|---|
| ***A61H 33/06*** | (2006.01) |
| ***A47C 4/03*** | (2006.01) |
| ***A47C 5/12*** | (2006.01) |
| ***A47C 13/00*** | (2006.01) |
| ***A47C 1/124*** | (2006.01) |
| *A61H 33/00* | (2006.01) |

(52) U.S. Cl.

CPC ..... *A47C 13/005* (2013.01); *A47K 3/122* (2013.01); *A61H 33/067* (2013.01); *A61H 33/6068* (2013.01); *A61H 2201/0107* (2013.01); *A61H 2201/0173* (2013.01); *A61H 2201/0192* (2013.01)

(58) Field of Classification Search

CPC ..... A47C 7/546; A47C 7/62; A47K 3/122; A47K 3/282

USPC ..... 297/188.2, 233, 243, 248, 338, 344.18, 297/411.24, 440.13, 440.14, 440.16, 297/440.2, 440.22, 440.24, 463.1; 4/559, 4/576.1–577.1, 578.1–579, 611

See application file for complete search history.

(56) References Cited

U.S. PATENT DOCUMENTS

| | | | | |
|---|---|---|---|---|
| 3,944,281 | A * | 3/1976 | Piretti | A47B 87/00 297/248 |
| 4,168,549 | A | 9/1979 | Davies | |
| 4,391,006 | A | 7/1983 | Smith | |
| 4,472,844 | A * | 9/1984 | Mace | A47K 3/122 4/579 |
| 4,475,256 | A | 10/1984 | Hatala | |
| D276,767 | S | 12/1984 | Livi | |
| D296,284 | S | 6/1988 | Colby | |
| D300,996 | S | 5/1989 | Colby | |
| D347,526 | S | 6/1994 | Hamilton | |
| 5,335,377 | A * | 8/1994 | Masyada | A47K 3/122 297/152 |
| 5,360,304 | A | 11/1994 | Austin | |
| 5,361,428 | A | 11/1994 | Nanowsky et al. | |
| 5,536,068 | A | 7/1996 | Valentor et al. | |
| 5,561,868 | A | 10/1996 | Campbell et al. | |
| D375,638 | S | 11/1996 | Dhanapal et al. | |
| 5,845,962 | A | 12/1998 | Lin | |
| 5,940,905 | A | 8/1999 | Cheng | |
| 6,000,750 | A * | 12/1999 | Rossman | A47D 1/004 108/11 |
| 6,039,403 | A * | 3/2000 | Hargroder | A47K 3/122 297/440.16 |
| 6,065,251 | A * | 5/2000 | Kindrick | A47K 3/001 108/157.13 |
| D427,814 | S | 7/2000 | Black | |
| 6,105,183 | A * | 8/2000 | Bly | A47K 3/122 297/94 |
| 6,122,776 | A | 9/2000 | Cheng | |
| D439,429 | S | 3/2001 | Higgs et al. | |
| D466,337 | S | 12/2002 | Feng | |
| D478,749 | S | 8/2003 | Gilbert et al. | |
| D478,750 | S | 8/2003 | Gilbert et al. | |
| D478,751 | S | 8/2003 | Gilbert et al. | |
| D478,752 | S | 8/2003 | Gilbert et al. | |
| D479,051 | S | 9/2003 | Darst et al. | |
| D479,067 | S | 9/2003 | Gilbert et al. | |
| 6,733,082 | B1 | 5/2004 | Treon | |
| 6,827,028 | B1 * | 12/2004 | Callaway | A47B 3/06 108/157.1 |
| D501,611 | S | 2/2005 | Self et al. | |
| 6,907,829 | B2 | 6/2005 | Bambach et al. | |
| D519,291 | S | 4/2006 | Higgs et al. | |
| 7,020,911 | B2 * | 4/2006 | Oldham | A47C 13/005 297/411.24 |
| 7,121,620 | B1 | 10/2006 | Fang | |
| 7,451,501 | B2 | 11/2008 | Cheng | |
| D582,185 | S | 12/2008 | Gilbert | |
| D596,866 | S | 7/2009 | Bergmann et al. | |
| 7,661,154 | B2 | 2/2010 | Cheng | |
| 7,690,055 | B2 | 4/2010 | Hammer et al. | |
| 7,761,935 | B1 | 7/2010 | Whitaker | |
| D637,417 | S | 5/2011 | Marcomini | |
| 8,127,377 | B2 | 3/2012 | Ferrazzani | |
| 8,152,233 | B2 | 4/2012 | Wechter | |
| 8,162,396 | B2 | 4/2012 | Edwards | |
| 8,181,285 | B1 * | 5/2012 | Jackson | A47K 3/122 297/16.1 |
| 8,291,526 | B2 | 10/2012 | Parvizian | |
| 8,307,600 | B2 | 11/2012 | Heartsfield | |
| D687,640 | S | 8/2013 | Pedersen et al. | |
| 8,925,264 | B2 | 1/2015 | Thrush et al. | |
| D723,814 | S | 3/2015 | Hagstrom | |
| 9,107,787 | B2 | 8/2015 | Wetcher | |
| 9,662,255 | B2 | 5/2017 | Wetcher | |
| 9,763,545 | B2 | 9/2017 | Liu | |
| D802,311 | S | 11/2017 | Stricklin et al. | |
| D823,020 | S | 7/2018 | Paterson et al. | |
| D833,765 | S | 11/2018 | Mammi | |
| 2004/0051365 | A1 * | 3/2004 | Darst | A47K 3/122 297/440.1 |
| 2004/0070238 | A1 | 4/2004 | Moser et al. | |
| 2005/0179304 | A1 | 8/2005 | Serhan | |
| 2007/0273181 | A1 | 11/2007 | Wechter | |
| 2010/0288453 | A1 | 11/2010 | Richardson | |
| 2012/0192351 | A1 * | 8/2012 | Wechter | A47K 3/122 4/578.1 |
| 2012/0233767 | A1 | 9/2012 | Liu | |
| 2013/0117928 | A1 | 5/2013 | Hardie | |
| 2016/0143493 | A1 | 5/2016 | Chang | |
| 2017/0303747 | A1 | 10/2017 | Fortman | |

FOREIGN PATENT DOCUMENTS

| | | |
|---|---|---|
| DE | 10206835 | 9/2003 |
| WO | 2001/070088 | 9/2001 |
| WO | 201709373 | 6/2017 |

OTHER PUBLICATIONS

"DeVilbiss Healthcare", Shower Chair with Back; http://www.drivemedical.com/b2b/index.php/shower-chair-with-back-and-removable-padded-arms-217.html; Unknown Publication Date but believe to be prior to filing of present application.

"Essential Medical", Molded Shower Chair; http://www.walmart.com/ip/Essential-Medical-B3011-Molded-Shower-Bench-with-Arms-Back/35306400; Unknown publication date but believe to be prior to filing of present application.

"RehabMart.com", Adjustable Shower Seats; http://www.rehabmart.com/product/adjustable-shower-seats-18745.html; Unknown Publication Date but believe to be prior to filing of present application.

"Single Cube Chair", CFC-999 Preschool Chairs; Hertz Furniture Website; http://www.hertzfurniture.com/Preschool---Chairs------Single---Cube---Chair------3462------mo.html; Unknown Publication Date but prior to filing of present application.

Seating Device Images gathered by inventors; IA Collaborative and Medline; Unknown original publication of each image; Unknown publication dates but believed to be prior to filing of present application.

"Medline Catalog", Basic Show Chair with Back; Medline Catalog; https://www.medline.com/catalog/catalog.jsp; Unknown Publication date but believed to be prior to present application filing date.

"Medline Catalog", Composite Bath Benches with Back; Medline Catalog; https://www.medline.com/catalog/catalog.jsp; Unknown Publication date but believed to be prior to present application filing date.

"Medline Catalog", Composite Transfer Benches; Medline Catalog; https://www.medline.com/catalog/catalog.jsp; Unknown Publication date but believed to be prior to present application filing date.

"Medline Catalog", Easy Care Shower Chair/Stool; Medline Catalog; https://www.medline.com/catalog/catalog.jsp; Unknown Publication date but believed to be prior to present application filing date.

(56) References Cited

OTHER PUBLICATIONS

"Medline Catalog", Home Care Glacier Shower Chair by Moen; Medline Catalog; https://www.medline.com/catalog/catalog.jsp; Unknown Publication date but believed to be prior to present application filing date.
"Medline Catalog", Knockdown Transer Benches; Medline Catalog; https://www.medline.com/catalog/catalog.jsp; Unknown Publication date but believed to be prior to present application filing date.
"Medline Catalog", Shower Chair with Back; Medline Catalog; https://www.medline.com/catalog/catalog.jsp; Unknown Publication date but believed to be prior to present application filing date.
"Medline Catalog", Shower Chair with Perineal Opening; Medline Catalog; https://www.medline.com/catalog/catalog.jsp; Unknown Publication date but believed to be prior to present application filing date.
"Medline Catalog", Shower Chairs with Microban; Medline Catalog; https://www.medline.com/catalog/catalog.jsp; Unknown Publication date but believed to be prior to present application filing date.
"Medline Catalog", Shower Chais/Stools by Invacare Corp; Medline Catalog; https://www.medline.com/catalog/catalog.jsp; Unknown Publication date but believed to be prior to present application filing date.
"Medline Catalog", Snap N Save Heavy Duty Shower Chairs by Performance Health; Medline Catalog; https://www.medline.com/catalog/catalog.jsp; Unknown Publication date but believed to be prior to present application filing date.
De, Mimosa, "Notice of Allowance", U.S. Appl. No. 29/558,299, filed Mar. 16, 2016; dated Dec. 12, 2017.
De, Mimosa , "Notice of Allowance", U.S. Appl. No. 29/558,299, filed Mar. 16, 2016, dated Mar. 26, 2018.
De, Mimosa , "Notice of Allowance", U.S. Appl. No. 29/570,679, filed Jul. 11, 2016, dated Mar. 8, 2018.
De, Mimosa , "Notice of Allowance", U.S. Appl. No. 29/612,169, filed Jul. 28, 2017; dated Mar. 25, 2019.
Deery, Erin L. , "NonFinal OA", U.S. Appl. No. 15/663,552, filed Jul. 28, 2017; dated Sep. 7, 2018.
Deery, Erin L. , "NonFinal Office Action", U.S. Appl. No. 15/663,552, filed Jul. 28, 2017; dated Sep. 16, 2019.
Deery, Erin Leah , "Final Office Action", U.S. Appl. No. 15/663,552, filed Jul. 28, 2017; dated Mar. 15, 2019.

* cited by examiner

MODULAR SEATING APPARATUS AND CORRESPONDING SYSTEMS AND METHODS

CROSS REFERENCE TO PRIOR APPLICATIONS

This application claims priority and benefit under 35 U.S.C. § 119(e) from U.S. Provisional Application No. 62/137,595, filed Mar. 24, 2015, which is incorporated by reference for all purposes.

BACKGROUND

Technical Field

This disclosure relates generally to seating devices, and more particularly to modular seating devices.

Background Art

Some people, including those who are infirm, elderly, or otherwise impaired, require assistance during daily activities. For example, while many take the act of taking a shower or getting into a tub for granted, others require special assistance to complete this simple task. A wheelchair bound person may require special equipment to move from wheelchair to tub and vice versa. One such piece of equipment suitable for this task is known as a "transfer bench." Traditional transfer benches straddle the edge of the tub so that the user can slide from the wheelchair into the tub for bathing. The user can then slide back to the wheelchair when finished.

Prior art transfer benches, chairs, and other mobility aids used for common activities such as bathing suffer from deficiencies. Illustrating by example, prior art mobility aids do not allow the user to comfortably move into, and out of, a tub. Moreover, most transfer benches can be unstable due to the complex curvature of many bathing tubs. Additionally, prior art benches and chairs lack the ability of the user to customize the device so as to tailor it to their personal needs. The user may or may not want a chair back for example. Prior art designs also interfere with the shower curtain, resulting in seat instability and water on the floor.

It would be advantageous to have an improved seating device.

Figure 1:
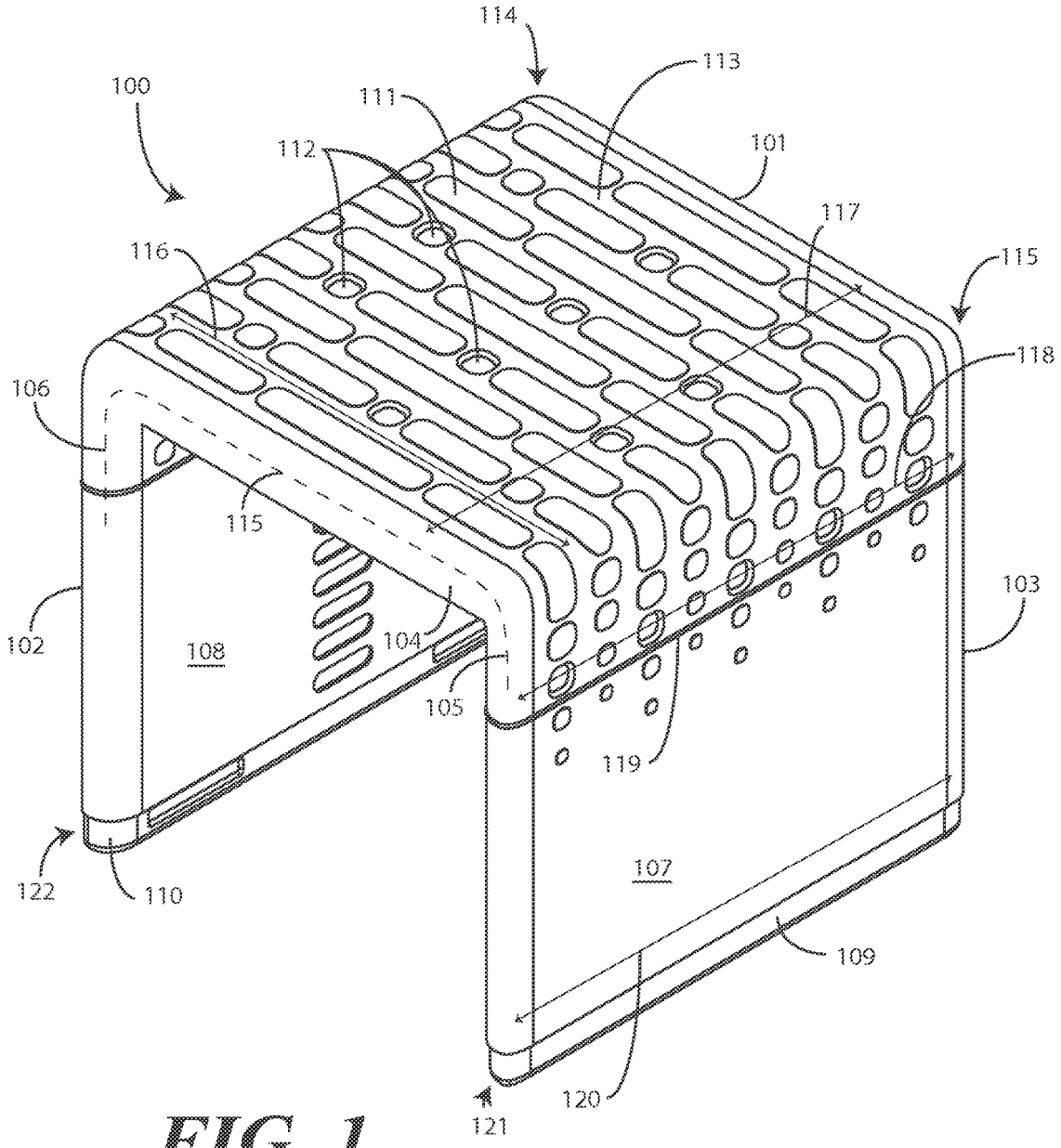
FIG. 1 illustrates an explanatory modular seating apparatus in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure describe a modular seating apparatus, which can be configured as a bench in one or more embodiments. The modular bench can be configured as with a cube-like geometry in one or more embodiments. The modular bench can also be coupled to other benches and/or accessories to transform from a basic seat into numerous and varied customized configurations.

In one embodiment, the bench includes an upper member, a first leg member, and a second leg member. The upper member can include a substantially planar portion defining a seat, a first side end portion, and a second side end portion. In one embodiment, the first side end portion extends distally from a first side of the seat, while the second side end portion extends distally from a second side of the seat. In one embodiment, both the first side end portion and the second side end portion extend from the seat at a substantially orthogonal angle. As used herein, the term "substantially" refers to an orientation or alignment inclusive of manufacturing tolerances. Thus, if the first side end portion extends "substantially orthogonally" from the seat, and the manufacturing tolerances are plus or minus two degrees, both 88.25 degrees and 91.576 degrees would be "substantially orthogonal" with the seat.

In one or more embodiments, the upper member, the first side end portion, and the second side end portion have a common dimension. For example, in one embodiment the seat defines a seat width and a seat length. Similarly, the first side end portion and the second side end portion have a side end portion length and a side end portion width. In one embodiment, the seat length is coextensive with the side end portion length. This results in the upper member defining an inverted "U" shape with squared corners.

In one embodiment, a first leg member and a second leg member are selectively attachable to a first boss and a second boss, respectively, that extend from the first side portion and the second side portion. The first leg member and the second leg member can frictionally fit to the first boss and the second boss. Alternatively, the first leg member and the second leg member can attach to the first boss and second boss with a snap mechanism as well. Other attachment techniques will be obvious to those of ordinary skill in the art having the benefit of this disclosure.

In one or more embodiments, one or both of the first leg member or the second leg member has a major dimension that is coextensive with the seat length. Accordingly, when the first leg member and the second leg member are attached to the first boss and the second boss, the first seat member and the second seat member look to be continuous extensions of the first side end portion and the second side end portion, respectively. This causes the modular seating apparatus to have the appearance of an open sided cube with a fourth side missing. Said differently, the modular seating apparatus defines an inverted U-shape with squared corners to look like the perimeter sides of a cube with one side missing.

In one or more embodiments, the first leg member and the second leg member each comprise an adjustment mechanism. In one embodiment, the adjustment mechanism comprises a push-button that can be pressed through an aperture of a plurality of apertures to allow a foot insert disposed within a casing sleeve to translate so as to selectively alter a height of one or both of the first leg member or the second leg member. Advantageously, this allows a user to adjust the height of either leg when placing the modular seating apparatus on surfaces with uneven heights, such as when one leg member is on a floor and another leg member is placed in a tub.

In one or more embodiments, the user can use the adjustment mechanism to fully release the foot insert from the casing sleeve. Once the foot insert is removed, a coupler can be inserted in its place. In one embodiment, the coupler can be used to connect two benches together. In one embodiment, the coupler has a width sufficient for a shower curtain to pass between the first bench and the second bench when the coupler is attached to the terminal end of a leg member on one bench and the terminal end of another leg member coupled to another bench. This configures the system as a broad transfer bench that can be placed over the side of a tub, and advantageously, that allows a shower curtain to pass between the two benches to prevent water from hitting the floor. Numerous other advantages will become obvious to those of ordinary skill in the art having the benefit of this disclosure.

Embodiments of the disclosure provide a new, innovative, and advantageous modular bench resembling a cube in its ornamental design for the shower or bath. Designed to adapt to the changing needs of the user, the timeless design set forth in embodiments of the disclosure are made to last from durable materials such as polyurethane. Advantageously, embodiments of the disclosure can be configured as a stool, chair, full transfer bench, or in other configurations. The design of embodiments of the disclosure provide for easy assembly and a reduced shipping size.

Turning now to FIG. 1, illustrated therein is one explanatory modular seating apparatus in accordance with one or more embodiments of the disclosure. In this explanatory embodiment, the modular seating apparatus is configured as a bench 100. However, as will be seen below with reference to FIGS. 22-23, the modular seating apparatus can also be configured as a chair. Other seating configurations will be obvious to those of ordinary skill having the benefit of this disclosure.

The explanatory bench 100 of FIG. 1 includes an upper member 101, a first leg member 103 and a second leg member 102. The upper member 101 includes a substantially planar portion 104, a first side end portion 105, and a second side end portion 106. In this illustrative embodiment, the substantially planar portion 104 defines a seat 113. While the seat 113 is substantially planar in this embodiment, it could have contours, recesses, and/or protrusions to better fit portions of a user's anatomy, such as their derriere. However, as will be shown in FIGS. 7-9 below, in one or more embodiments the seat 113 is configured to be substantially planar so that the bench 100 can be coupled to another bench to form a transfer bench. Additionally, it is frequently easier for a user to slide across a substantially planar surface than a curved surface in many instances.

In one embodiment, the seat 113 includes a textured surface 111 disposed along a first major face of the seat 113 to allow water to flow therethrough. The unique linear texture shown in FIG. 1 defining the textured surface 111 creates an exciting ornamental aesthetic. However, at the same time the textured surface 111 also provides grip and control to the user when in use.

In one or more embodiments, one or more apertures 112 are disposed along the seat 113 to provide integrated drainage features. The textured surface 111 may also include raised portions disposed along selective areas to allow for water drainage through the one or more apertures 112. Additionally, the textured surface 111 increases friction, helping to ensure a user does not slop off the seat 113. Embodiments of the disclosure contemplate that too many voids disposed along the seat 113 may weaken the structural integrity of the bench 100. The textured surface 111 may also function to direct water to some of the apertures 112 as well.

In one embodiment, the first side end portion 105 and the second side end portion 106 extend substantially orthogonally away from the substantially planar portion 104. In the illustrative embodiment of FIG. 1, the first side end portion 105 extends substantially orthogonally from the seat 113 at a first side 115 of the seat 113. Similarly, the second side end portion 106 extends substantially orthogonally from the seat 113 at a second side 114 of the seat 113. Here, the second side 114 of the seat 113 is located distally opposite the seat 113 from the first side 115 of the seat 113. Accordingly, the substantially planar portion 104, the first side end portion 105 and the second side end portion 106 define an inverted U-shape 115 having squared corners.

The seat 113 defines a seat width 116 and a seat length 117. While different designs will have different seat widths and lengths, in one explanatory embodiment the seat width 116 is between sixteen and seventeen inches. In one embodiment, the seat width 116 is about 16.7 inches. In one embodiment the seat length 117 is shorter than the seat width 116. For example, in one embodiment the seat length 117 is between fifteen and sixteen inches. In one embodiment, the seat length 117 is about 15.7 inches. These dimensions are illustrative only, as others will be readily apparent to those of ordinary skill in the art having the benefit of this disclosure.

In one or more embodiments, the first side end portion 105 and the second side end portion 106 have a major dimension that is coextensive with a major dimension of the seat 113. In this illustrative embodiment, both the first side end portion 105 and the second side end portion 106 define a side end portion length 118 and a side end portion length 119. Here, the seat length 117 and the side end portion length 118 are coextensive such that it appears as if the first side end portion 105 and the second side end portion 106 are merely "folded over" portions of the seat 113 defining the inverted U-shape 115.

In this illustrative embodiment, the first leg member 103 and the second leg member 102 also have a major dimension that is coextensive with a major dimension of the upper member 101. As shown in FIG. 1, in one embodiment the first leg member 103 and the second leg member 102 define a leg member length 120 that is coextensive with the seat length 117. Here, the leg member length 120 is also coextensive with the side end portion length 119. Accordingly, when the first leg member 103 and the second leg member 102 are attached to the upper member 101, the resulting assembly appears to be an open sided cube that is missing a fourth side that ordinarily would connect a terminal end 121 of the first leg member 103 and another terminal end 122 of the second leg member 102. Given that the bench 100 can resemble such an open-sided cube, the bench 100 is sometimes referred to as a "bath cube."

In one or more embodiments, the bench 100 can be manufactured from a material with sufficient rigidity as to support the weight of a user and allow the lateral movement (such as sliding movement) of the user across the seat 113 when the first leg member 103 and the second leg member 102 are attached to the first side end portion 105 and the second side end portion 106, respectively. Examples of such materials include high-strength thermoplastic materials, metal, wood, wood composites, aluminum, fiberglass, or combinations thereof. Still other suitable materials will be obvious to those of ordinary skill in the art having the benefit of this disclosure. For example, in one embodiment each of the upper member 101, the components of the first leg member 103, and the components of the second leg member 102 are manufactured from a blow-molded thermoplastic, such as polyurethane. In another embodiment, each of the upper member 101, the components of the first leg member 103, and the components of the second leg member 102 are manufactured from an injection molding process. In another embodiment, each of the upper member 101, the components of the first leg member 103, and the components of the second leg member 102 are manufactured from a gas-blown injection molding process, which allows for a wide range of color choices. In another embodiment, each of the upper member 101, the components of the first leg member 103, and the components of the second leg member 102 are manufactured from a co-molding process that involves both blow molding and injection molding. Other suitable materials include high modulus polypropylene. Where metal is used, the metal may be coated with a rust corrosion preventative material. In other cases, a rust-resistant material, such as aluminum or stainless steel, can be used as well.

Figure 2:
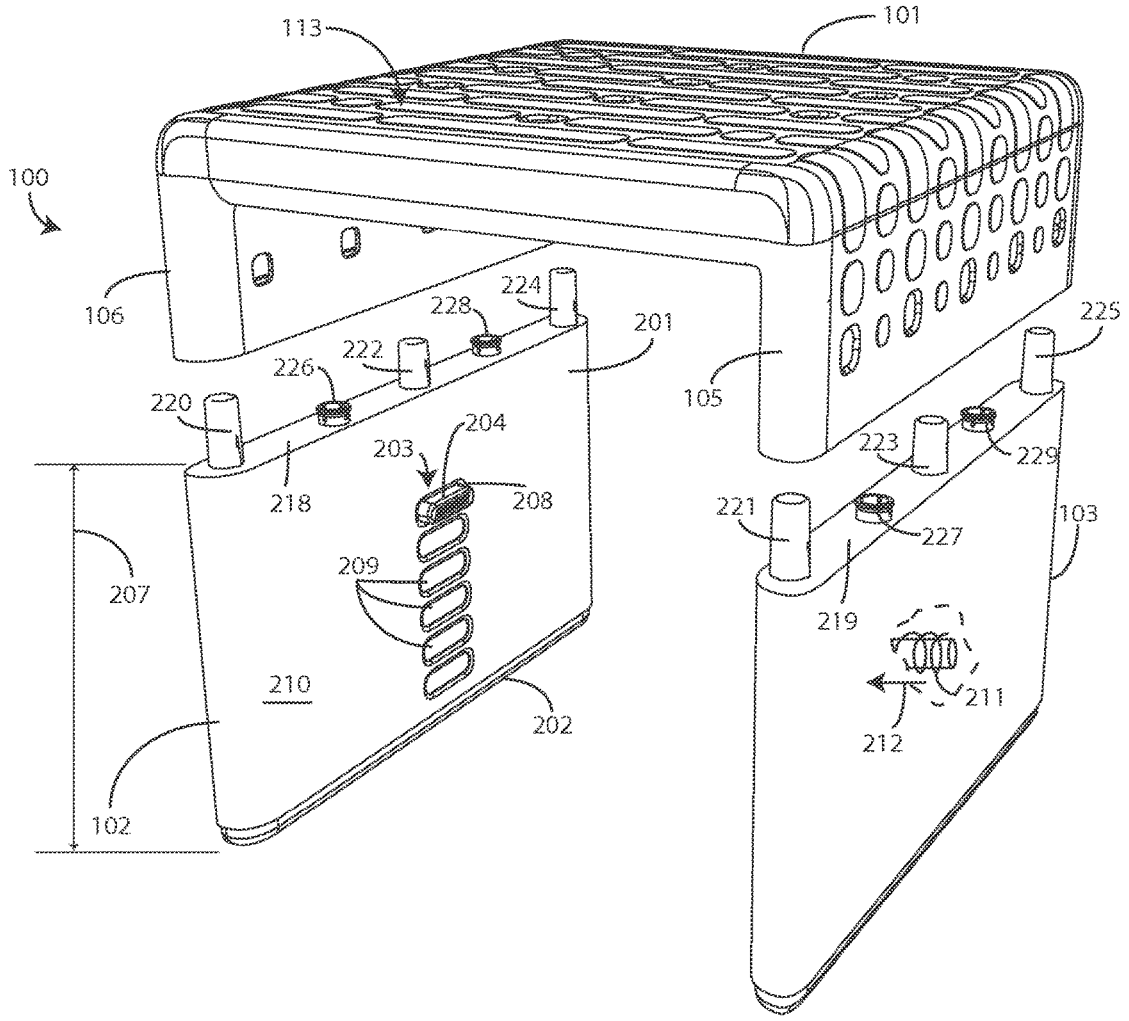
FIG. 2 illustrates an exploded view of one explanatory modular seating apparatus in accordance with one or more embodiments of the disclosure.

Turning now to FIG. 2, illustrated therein is an exploded view of the bench 100 illustrating how the first leg member 103 and the second leg member 102 can attach to the first side end portion 105 and the second side end portion 106, respectively. As shown in FIG. 2, in one embodiment each of the first leg member 103 and the second leg member 102 terminates at an end 218,219 along which at least one boss 220,221,222,223,224,225 is disposed. For example, the first side end portion 105 terminates at an end 218 having three bosses 220,222,224 in one embodiment, while the second side end portion 106 terminates at an end 219 having three bosses 221,223,225. Fewer or more bosses could be included along each end 218,219 depending upon application. The first leg member 103 is selectively attachable, via the three bosses 221,223,225, to the first side end portion 105 when the bosses 221,223,225 insert into complementary receiving apertures disposed along the underside of the first side end portion 105. Similarly, the second leg member 102 is selectively attachable, via its three bosses 220,222,224 to the second side end portion 106. As used herein, the term "selectively" refers to a condition that can be entered into, or exited from, at the discretion of a user. For example, a "selectively attachable" leg member means that the user can decide to attach the leg member to the upper member 101, or can decide to detach the leg member to the upper member 101.

In one or more embodiments, each of the first leg member 103 and the second leg member 102 can further include snap mechanisms 226,227,228,229 disposed at the ends 218,219. For example, in this illustrative embodiment the first leg member 103 comprises two snap mechanisms 227,229 to insert into complementary receiving apertures disposed along the underside of the first side end portion 105 retain the first leg member 103 to the first side end portion 105 when the bosses 221,223,225 are inserted into the end of the first side end portion 105. The second leg member 102 is similarly configured.

In one or more embodiments, each leg member is itself an assembly. Illustrating by example, in this explanatory embodiment the second leg member 102 comprises a casing sleeve 201, a foot insert 202 disposed within the casing sleeve 201, and an adjustment mechanism 203. The adjustment mechanism 203 allows a user to selectively alter a height 207 of the second leg member 102. The first leg member 103 is similarly configured.

In this illustrative embodiment, the adjustment mechanism 203 comprises a push button 204 to selectively protrude through one aperture 208 of a plurality of apertures 209 disposed along a sidewall 210 of the second leg member 102. A compressible biasing device 211, shown as a coiled spring in the cutaway view along the first leg member 103 in this embodiment (which would be biased against the push button of the push button of the first leg, but is similar in configuration to the compressible biasing device of the second leg member 102 and is being illustrated in the first leg member 103 for convenience), is disposed between the push button 204 and the foot insert 202 to apply a preloading force 212 biasing the push button away from the foot insert 202 and through an aperture 208 selected by a user.

Figure 3:
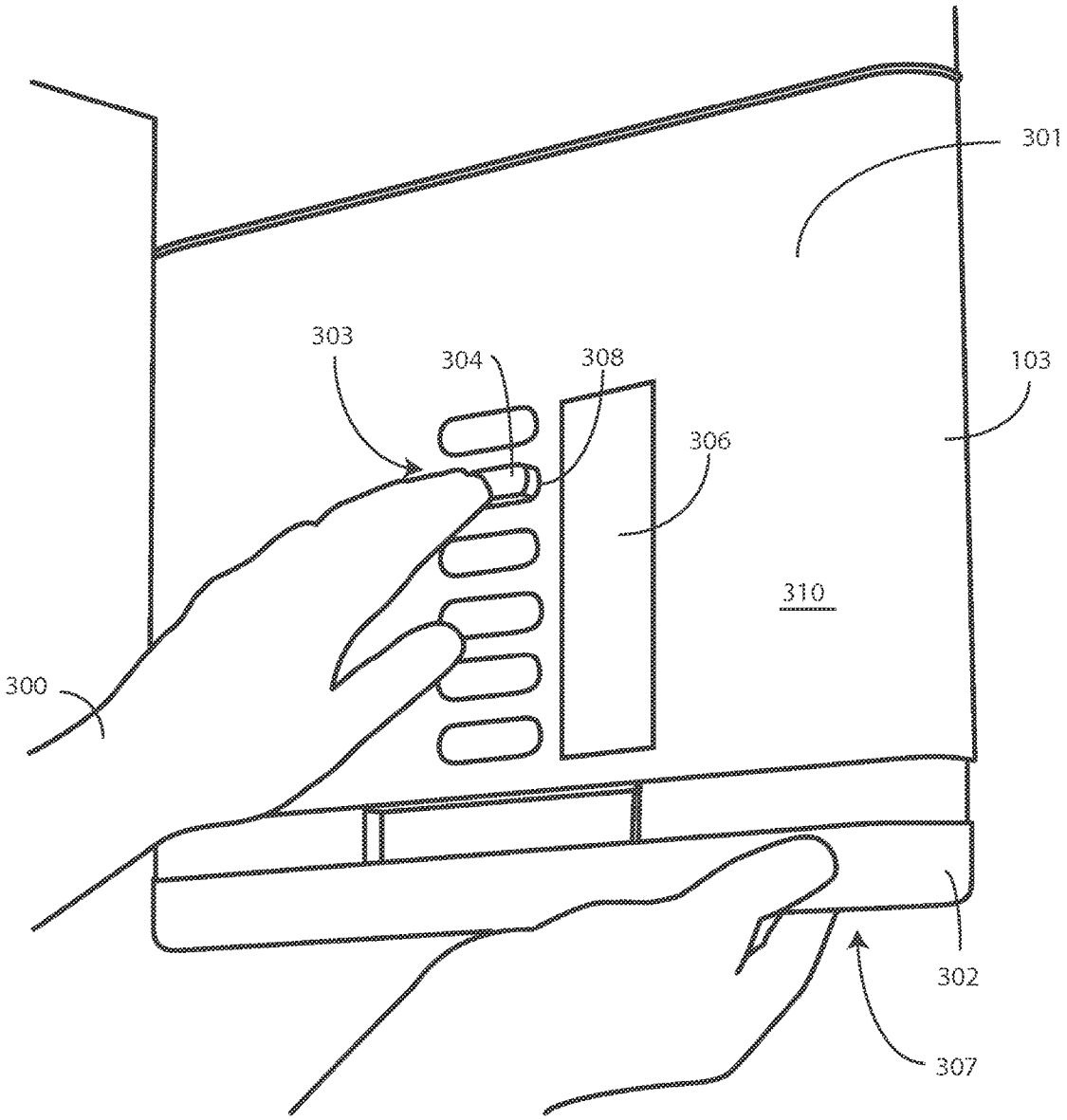
FIG. 3 illustrates a user adjusting a leg member of an explanatory modular seating apparatus in accordance with one or more embodiments of the disclosure.

Turning now to FIG. 3, a user 300 is shown adjusting 303 the first leg member 103. In one or more embodiments, the foot insert 302 can be selectively raised and lowered within the casing sleeve 301 to change the height of the first leg member 103 to accommodate the user's needs. The user 300 simply presses the push button 304 into the aperture 308 through which it protrudes and slides 307 the foot insert 302 up or down as desired. For example, the user 300 may adjust the first leg member 103 so that the bench 100 could straddle the side of a tub with the seat 113 remaining substantially parallel to the floor.

In one embodiment, the inner sidewall 310 of the casing sleeve 301 can include markings 306, demarcations, or other visible indicia to provide the user 300 with a convenient adjustment guide to assist the user 300 in adjusting the leg height. For example, there may be markings on the side of the cube that the user matches up with the tub height when they place the bench 100 next to the tub. A number can correspond to a matching number next to the push button 304 so that the user 300 does not have to go through trial and error when setting up the bench.

The user 300 can set the height (207) of each of the first leg member 103 and the second leg member (102) with the adjustment mechanism (203) to the same number, as indicated by the markings 306. Consider the use case where the user 300 places the bench 100 next to a tub. The height of the tub aligns with the number "5" indicated in the markings 306. In such a use case, the user 300 can adjust 303 the first leg member 103 and the second leg member (102) by moving the push button 304 to the aperture 308 next to the number "5" marking. The numbers indicated in the markings 306 may also correspond to the user's height as well or other measurements corresponding to leg member height. In one or more embodiments, the numbers or other indicia set forth in the markings 306 would be large so as to be easy-to-read and highly visible.

In one or more embodiments, the height of the bench (100) can be adjusted in six one-inch increments to adapt to the ideal size for the user. Such adjustability also provides maximum stability the bench (100) is used as a transfer bench for a user to enter and exit a bathtub. Advantageously, in one embodiment only two push buttons 304,(204) are included—with one disposed along the first leg member 103 and another disposed on the second leg member 102—so that a user only has to make two adjustments to completely alter the height of the bench (100). This is in contrast to four-legged stools where a user would need to make four adjustments to achieve the same effect.

In one or more embodiments the push button 304 comprises an oversized button to increase visual and tactile usability. In one embodiment, each of the push button 304, the foot insert 302, and the casing sleeve 301 are all color matched for a streamlined and consistent aesthetic.

Figure 4:
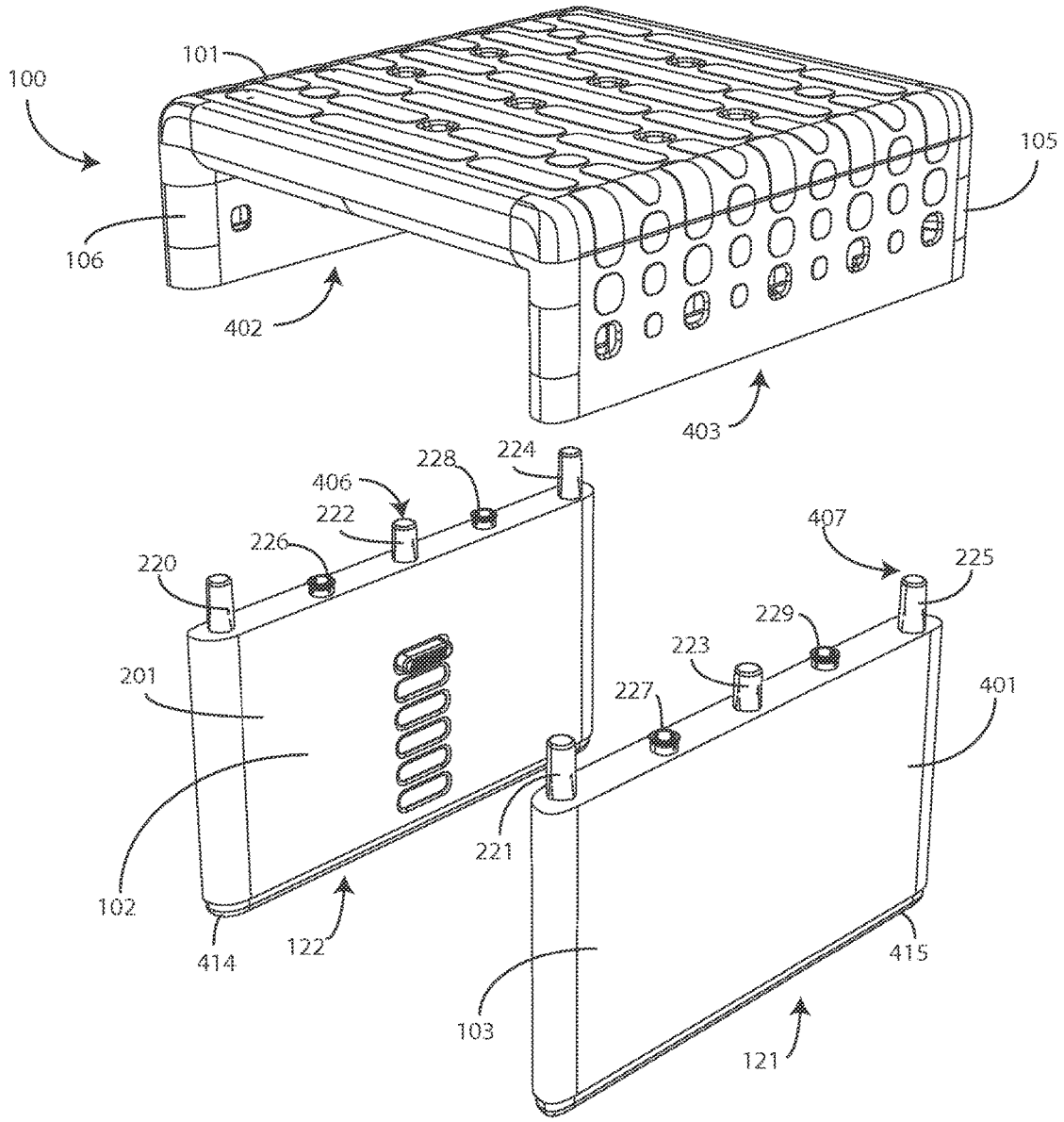
FIG. 4 illustrates an exploded view of another modular seating apparatus in accordance with one or more embodiments of the disclosure.

Turning now to FIG. 4, in one embodiment each casing sleeve 201,401 has an ovular cross section 404,405. In this embodiment, each of the bosses 220,221,222,223,224,225 has a circular cross section 406,407 that inserts into the bottom end 402,403 of each of the first end member 105 and the second end member 106.

In one embodiment, when the first leg member 103 and the second leg member 102 are attached to the upper member 101, the bosses 220,221,222,223,224,225 engage each complementary aperture receivers in the bottom end 402,403 of each of the first end member 105 and the second end member 106 with a frictional fit. Where, for example, each part is manufactured from a plastic material such as polyurethane, engagement of the bosses 220,221,222,223, 224,225 engage each complementary aperture receivers in the bottom end 402,403 of each of the first end member 105 and the second end member 106 results in frictional retention of the two components to each other.

In other embodiments, to provide a more robust coupling, one or both of the first leg member 103 or the second leg member 102 can include a snap mechanism. For example, in FIG. 4 each of the first leg member 103 and the second leg member 102 includes a pair of snap mechanisms 226,227, 228,229. The snap mechanisms 226,227,228,229 to insert into complementary receiving apertures disposed along the underside of the first side end portion 105 and the second side end portion 106, respectively, to retain the first leg member 103 and the second leg member 102 to the upper member 101. In another embodiment, the snap mechanism 226,227,228,229 could be placed on the first side end member 105 and the second side end member 106 rather than on the first leg member 103 or the second leg member 106. Of course, a combination approach could be used, with some snap mechanisms on the leg members and others on the side end members. Other coupling techniques will be obvious to those of ordinary skill in the art having the benefit of this disclosure. For example, in one embodiment the first leg member 103 and the second leg member 102 attach to the upper member 101 through a press snap-fit connection.

In one or more embodiments, each of the first leg member 103 and the second leg member 102 includes a rubber grip foot 414,415 disposed at a terminal end 121,122 of each of the first leg member 103 and the second leg member 102. The rubber grip foot 414,415 can be manufactured from a high-friction rubber or polymer so as to securely "grip" the floor or the surface of a tub when the bench 100 is placed along such a surface. In one embodiment, the rubber grip foot 414,415 is attached to the foot insert (302) inserted within each casing sleeve 201,401.

Figure 5:
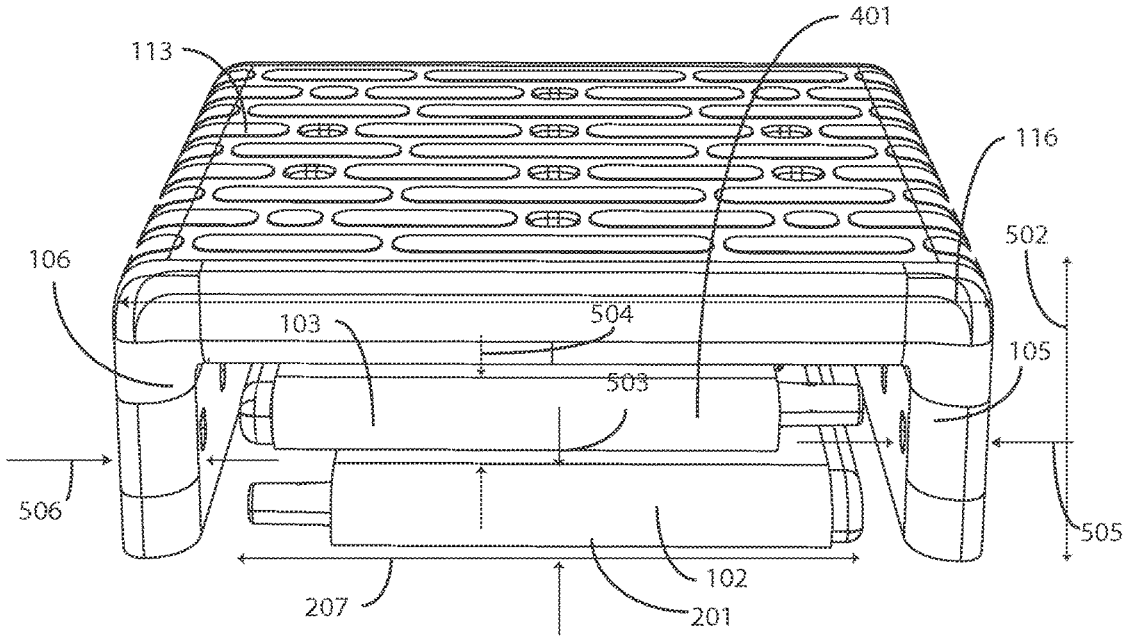
FIG. 5 illustrates one explanatory modular seating apparatus in a disassembled state in accordance with one or more embodiments of the disclosure.
Figure 6:
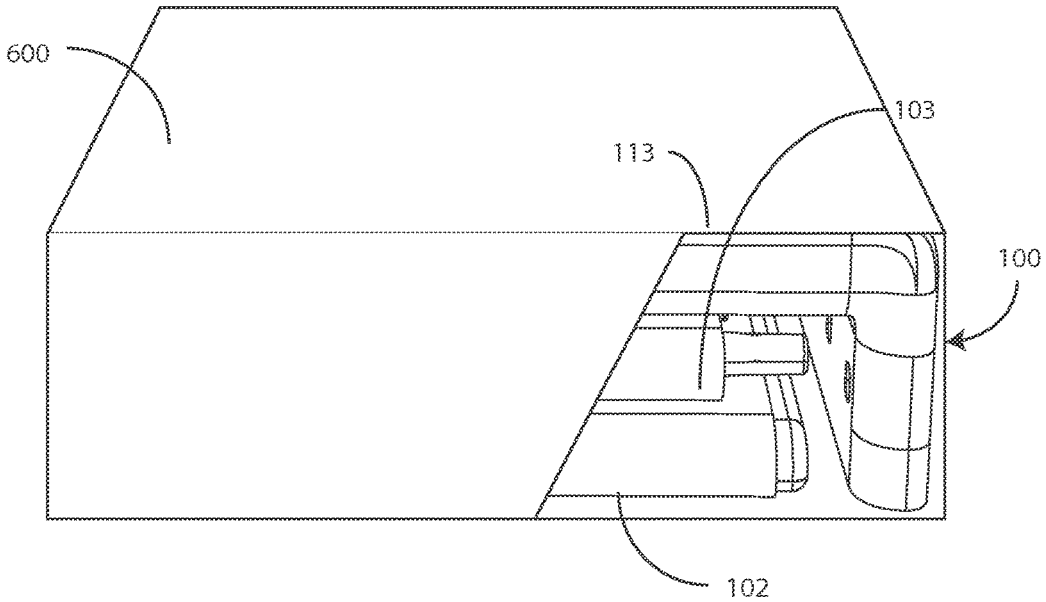
FIG. 6 illustrates a cutaway view of one explanatory modular seating apparatus disposed within packaging in a disassembled state in accordance with one or more embodiments of the disclosure.

The selectable attachability of the first leg member 103 and the second leg member 102 becomes a real advantage when shipping and/or storing the bench 100. Turning now to FIGS. 5 and 6, this advantage is illustrated in further detail.

Beginning with FIG. 5, in one embodiment each of the first leg member 103 and the second leg member 102 has a height 207, when the foot insert (302) is fully inserted into its corresponding casing sleeve 201,401, that is less than the seat width 116 of the seat 113 minus the thickness 505,506 of the first side end portion 105 and the second side end portion 106. Additionally, in this embodiment the thickness 503,504 of the first leg member 103 and the second leg member 102 is less than a height 502 of the first side end portion 105 and the second side end portion 106. Accordingly, both the first leg member 103 and the second leg member 102 can be stowed beneath the seat 113.

As shown in FIG. 6, this allows the disassembled bench 100 to be packaged in a compact package 600. The package 600 is shown in a cutaway view in FIG. 6. The ability to stow the first leg member 103 and the second leg member 102 beneath the seat 113 allows for more compact package dimensions when compared to prior art seats. While some prior art seats are collapsible, they can be quite bulky even when in their collapsed states. Embodiments of the present disclosure contemplate that one of the reasons for this bulk in the collapsed state is due to the fact that the folding components of prior art seating fold only in certain locations to ensure that the seats remain stable when unfolded. This locational folding thus adds length and width to the collapsed chair. This large size presents problems.

One such problem is that of shelf space in retail outlets. Embodiments of the disclosure contemplate that many retailers, including drug stores, big box stores, and other retailers generally do not put bath chairs on their shelves—even in the collapsed state—because the accompanying packaging is just too large. Advantageously, embodiments of the disclosure can be fit within a package 600 that measures 16.1 inches by 5.6 inches by 17 inches. This compact packaging allows the disassembled bench 100 to be placed in a package 600 that fits on a retailer's shelf in accordance with their predefined size requirements. Embodiments of the disclosure contemplate that retailers are willing to place packages having a length of less than about twenty-three inches, a width of less than about twenty-one inches, and a height of less than about nine inches on their shelves. Accordingly, as embodiments of the disclosure are smaller than these limitations, with the package 600 of FIG. 6 a user can see and select the bench 100 as an in-store, off-the-shelf purchase.

Figure 7:
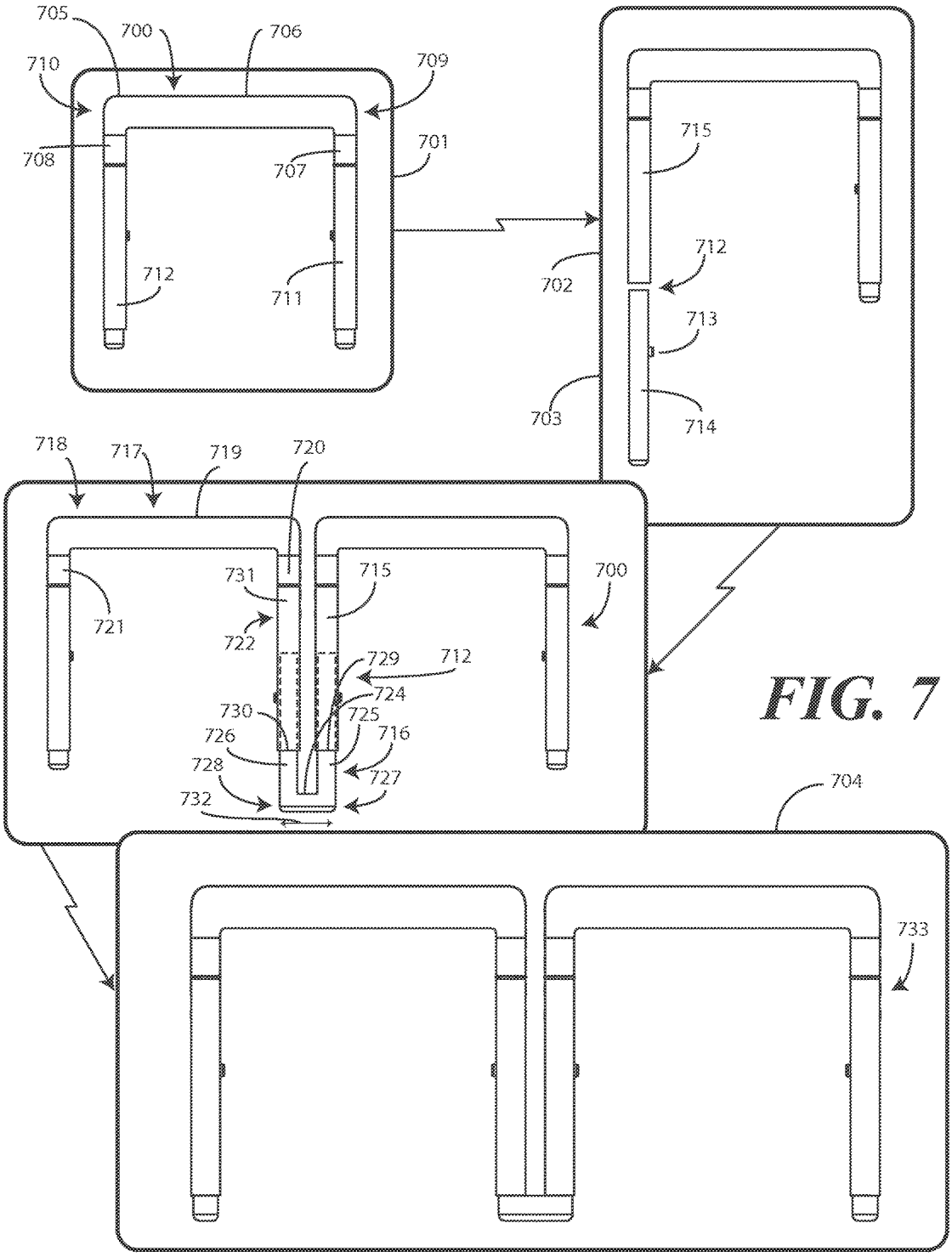
FIG. 7 illustrates one or more method steps for attaching modular seating apparatuses together in accordance with one or more embodiments of the disclosure.

In one or more embodiments, the bench 100 can be attached to other benches to form large structures, such as a transfer bench. Turning now to FIG. 7, illustrated therein are one or more method steps 701,702,703,704 showing how this can be accomplished.

Beginning at step 701, a first bench 700 is shown. As previously described, in one embodiment the first bench 700 includes a first upper member 705 defining a seat 706, a first side end portion 707, and a second side end portion 708. In this explanatory embodiment the first side end portion 707 and the second side end portion 708 extend distally from a first end 709 of the seat 706 and a second end 710 of the seat 706, respectively. A first leg member 711 is attached to the first side end portion 707. A second leg member 712 is attached to the second side end portion 708. To create the ornamental appearance of a cube when viewed from the side (along the page in FIG. 7, the first leg member 711 includes a first major dimension that is coextensive with a major dimension of the first side end portion 707, while the second leg member 712 has the same major dimension so as to be coextensive with the second side end portion 708.

As shown at step 702, by pressing the push button 713 of the second leg member 712, the foot insert 714 can be selectively removed from its corresponding casing sleeve 715. As shown at step 703, in one or more embodiments a coupler 716 can be included with the bench 700. The coupler 716 can insert into the casing sleeve 715 to attach the bench 700 to another bench 717.

As with the first bench 700, in one embodiment the second bench 717 includes a second upper member 718 defining a second seat 719, a third side end portion 729, and a fourth side end portion 721. Here, the third side end portion 720 and the fourth side end portion 721 extend distally from opposite ends of the second seat 719, respectively. A third leg member 722 is attached to the third side end portion 720, while a fourth leg member 723 is attached to the fourth side end portion 721. The foot insert of the third leg member 722 has been removed, as was the foot insert 714 of the second leg member 712 in step 702.

In one embodiment, the coupler 716 includes a footer 724, a first side section 725, and a second side section 726. In one embodiment, the first side section 725 extends substantially orthogonally from a first end 727 of the footer 724, while the second side section 726 extends substantially orthogonally from a second end 728 of the footer 724. The coupler 716 is to attach to a terminal end 729 the second leg member 712 to another terminal end 730 of the third leg member 722 by inserting into each casing sleeve 715,731.

In one embodiment, the coupler 716 has a width 732 sufficient for a shower curtain to pass between the first bench 700 and the second bench 717 when the coupler 716 is attached to the a terminal end 729 the second leg member 712 to another terminal end 730 of the third leg member 722. Said differently, in one embodiment the footer 724 has a width of at least two inches to allow a shower curtain 802 to pass between the first bench 700 and the second bench 717 when coupled together by the coupler 716 to form a transfer bench 733, as shown in step 703. This is shown in FIG. 8.

Figure 8:
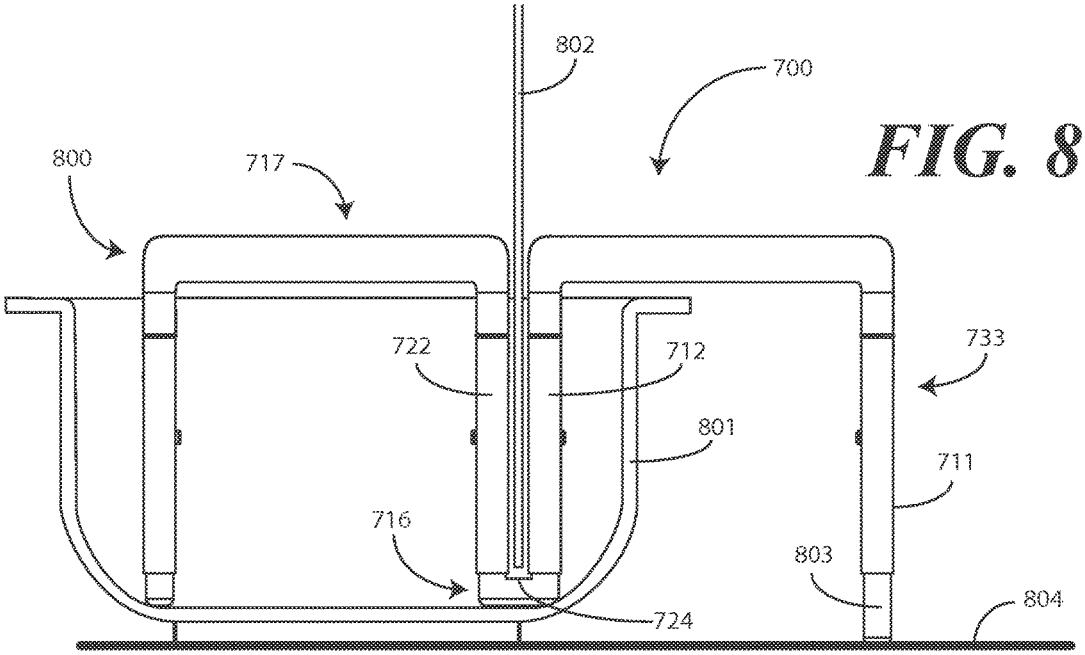
FIG. 8 illustrates one explanatory modular seating system in accordance with one or more embodiments of the disclosure.

Turning to FIG. 8, a bench assembly is shown as a transfer bench 733 where the first bench 700 straddles the side 801 of a bathtub 800. The first bench 700 is connected to the second bench 717 with the coupler 716. A shower curtain 802 is then able to pass between the second leg member 712 and the third leg member 722 due to the width of the footer 724 of the coupler 716. Through easy adjustment of the leg members (e.g., foot insert 803 of first leg member 711 has been extended farther than the others), the transfer bench 733 can even out the height difference between the bathtub 800 and the floor 804.

Figure 9:
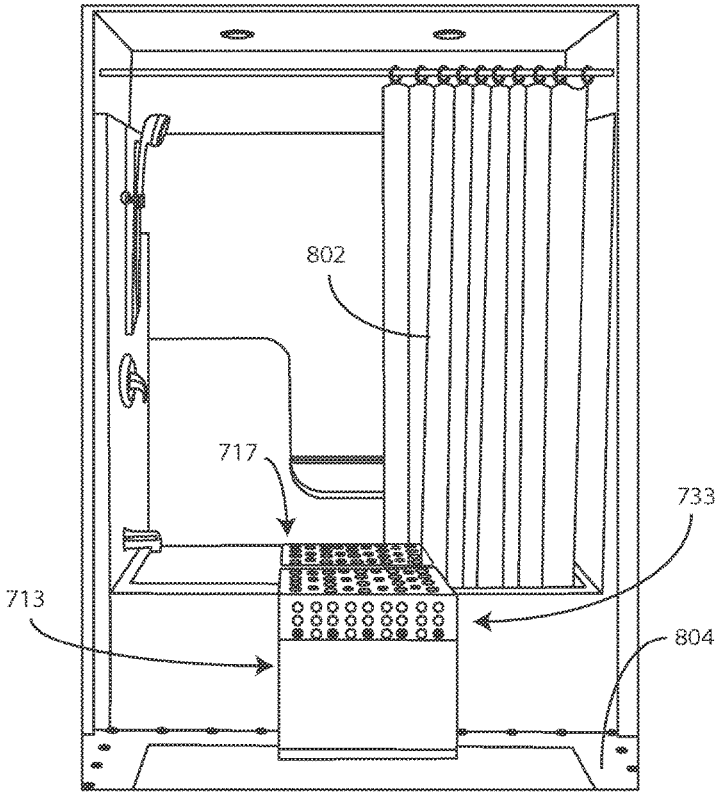
FIG. 9 illustrates one explanatory use case for a modular seating system in accordance with one or more embodiments of the disclosure.

As shown in FIG. 9, a user can easily draw and retract the shower curtain 802 through the transfer bench 733 to prevent water from being splashed on the floor 804. Advantageously, when two benches 700,717 are connected by the coupler (716), they can become a fully functional transfer bench 733. The shower curtain 802 simply slides through the gap between the two benches 700,717, which is a significant advantage over prior art designs. Additionally, the shower curtain 802 can be a standard shower curtain, with no modifications or customization to accommodate the transfer bench 733 needed.

Figure 10:
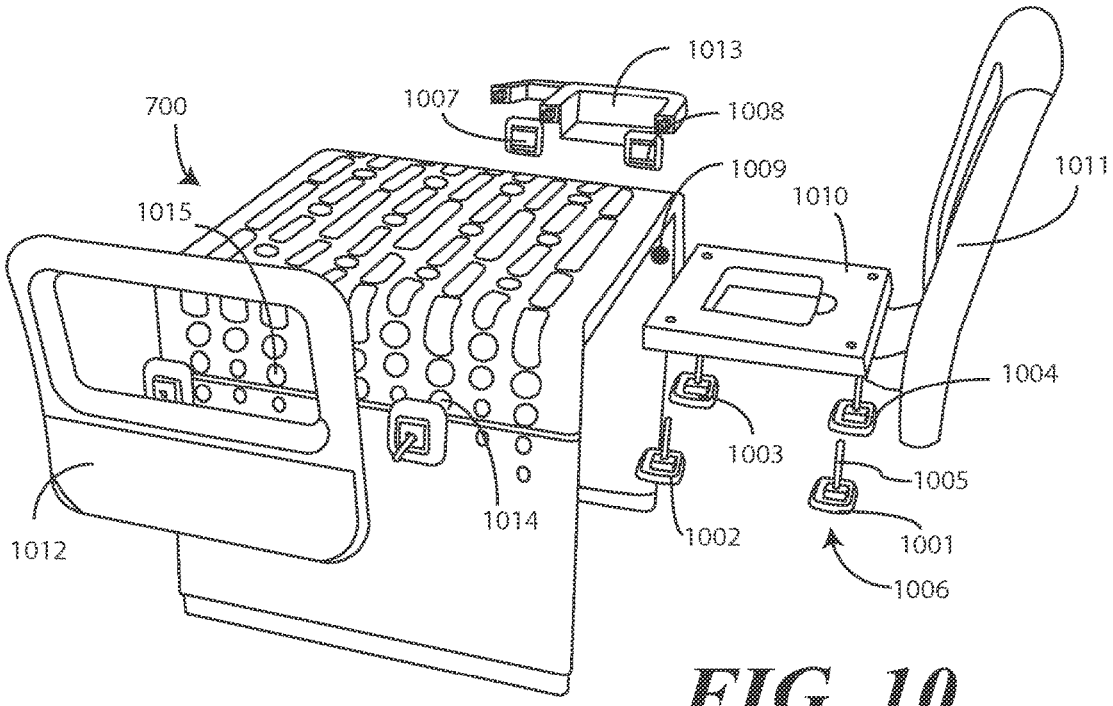
FIG. 10 illustrates an explanatory modular seating system having one or more attachable accessories in accordance with one or more embodiments of the disclosure.

As noted above, one primary advantage of embodiments of the disclosure is the ability to customize the basic "bath cube" to tailor it to a user's needs. Turning now to FIG. 10, illustrated therein is one way these accessories can be included with a bench 700 to form a unique system.

As shown in FIG. 10, in one embodiment one or more threaded retention devices 1001,1002,1003,1004 can be included. Each threaded retention device 1001,1002,1003, 1004 includes a threaded member 1005 and a large handle 1006. The threaded member 1005 can screw into a threaded aperture 1009 disposed along a surface of the bench 700, or alternatively a threaded aperture 1007,1008,1010 disposed along an accessory, to attach one or more accessories to the bench 700.

In one or more embodiments, each large handle 1006 has a square cross section to enable tool-less rotation of the corresponding threaded retention device 1001,1002,1003, 1004. Said differently, the large handle 1006, with its easily graspable square cross section, allows a user to rotate the threaded retention device 1001,1002,1003,1004 without the use of tools to release it from a corresponding threaded aperture disposed along a surface of the bench 700 or in one of the accessory devices. For this reason, the threaded retention devices 1001,1002,1003,1004 are referred to herein as "tool-less" retention devices that allow quick, tool-less removal of the accessories from the bench 700. In one or more embodiments, each threaded retention device 1001,1002,1003,1004 allows easy installation of accessories by hand, as the large handle 1006 reduces the need for caregiver assistance during assembly.

In the illustrative embodiment of FIG. 10, three explanatory accessories are shown: a backrest 1011, an arm rest 1012, and a combination soap dish and showerhead holder 1013. Other accessories will be obvious to those of ordinary skill in the art having the benefit of this disclosure. Each can be attached with a threaded retention device 1001,1002, 1003,1004. For example, the four threaded retention devices 1001,1002,1003,1004 can pass through threaded apertures 1010 in the backrest 1011 into a threaded aperture of the bench 700 to attach the backrest 1011 to the bench 700. Other threaded retention devices can be passed through other apertures 1014,1015 in the bench 700 to engage threaded apertures disposed in the armrest 1012 to attach the armrest 1012 to the bench 700. Still other threaded retention devices can be passed through other apertures in the bench 700 to engage threaded apertures 1007,1008 in the combination soap dish and showerhead holder 1013 to couple it to the bench 700.

Figure 11:
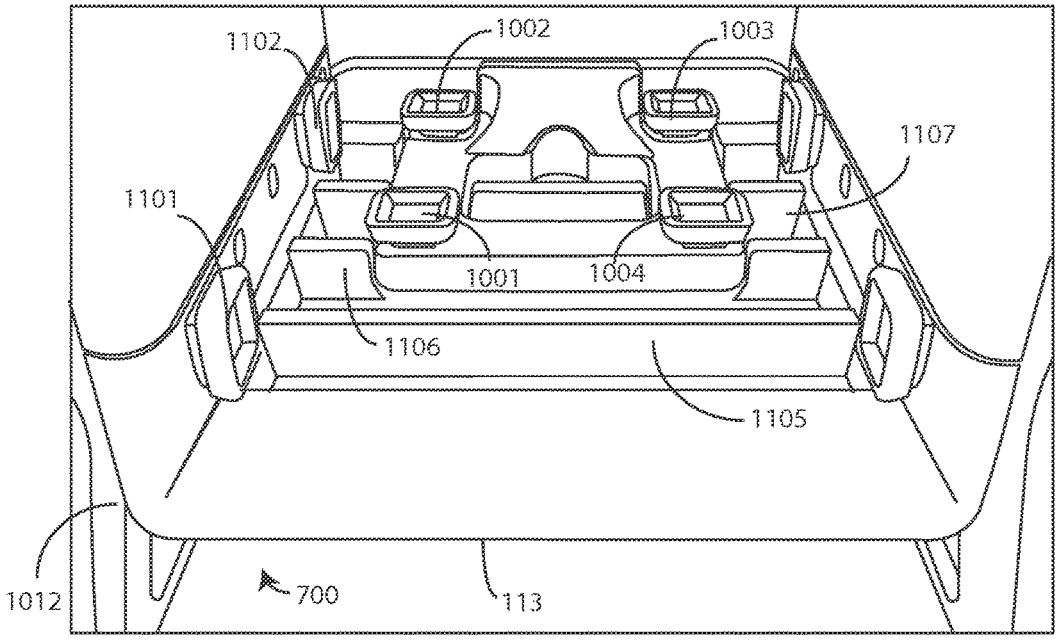
FIG. 11 illustrates explanatory threaded coupling members attaching explanatory accessories to an explanatory modular seating system in accordance with one or more embodiments of the disclosure.
Figure 12:
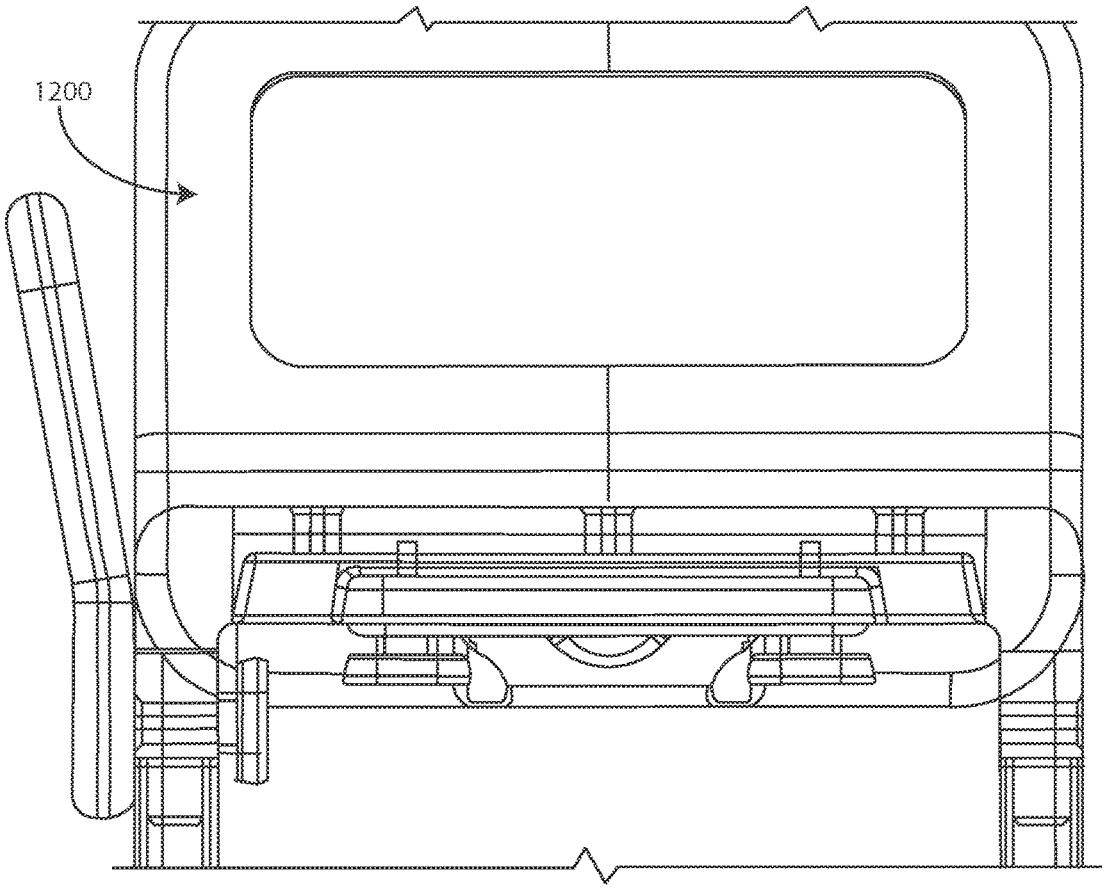
FIG. 12 illustrates a transparent view of explanatory threaded coupling members attaching explanatory accessories to an explanatory modular seating system in accordance with one or more embodiments of the disclosure.

This coupling is shown in FIG. 11, where four threaded retention devices 1001,1002,1003,1004 can engage threaded apertures of the bench 700 to attach the backrest 1011 to the bench 700. Similarly, threaded retention devices 1101,1102 pass through other apertures (1014,1015) in the bench 700 to engage threaded apertures disposed in the armrest 1012 to attach the armrest 1012 to the bench 700. Threaded retention devices 1103,1104 pass through other apertures in the bench 700 to engage threaded apertures (1007,1008) in the combination soap dish and showerhead holder (1013) to couple it to the bench. This is also shown in a sectional view 1200 in FIG. 12.

Advantageously, the use of threaded retention devices 1001,1002,1003,1004,1101,1102, 1103,1104 allows a user to easily attach any accessory to the bench 700 as desired. Moreover, the bench 700 can be reconfigured as the user's needs change. This scalable platform results in cost saving to the user and introduces a more sustainable model for bath safety products. Armrests, chair backs, soap dishes, and other accessories provide a full range of adaptability and versatility for the user. Embodiments of the disclosure provide the first ever-expandable bath safety seat with an array of convenient accessories. The design of the embodiments of the disclosure provides mounting locations for numerous add-on components.

Another feature of one or more embodiments of the bench 100 can be seen in FIG. 10, namely, the fact that in one or more embodiments one or more support ribs 1105,1106, 1107 can be disposed along a bottom major face of the seat 113. Embodiments of the disclosure contemplate that the overall structure of the bench should ensure basic load bearing performance. Accordingly, in one or more embodiments one or more support ribs 1105,1106,1107 can be disposed along a second major face, i.e., the bottom major face in this embodiment, of the seat 113. These support ribs 1105,1106,1107 provide additional structural rigidity and load bearing performance.

Figure 13:
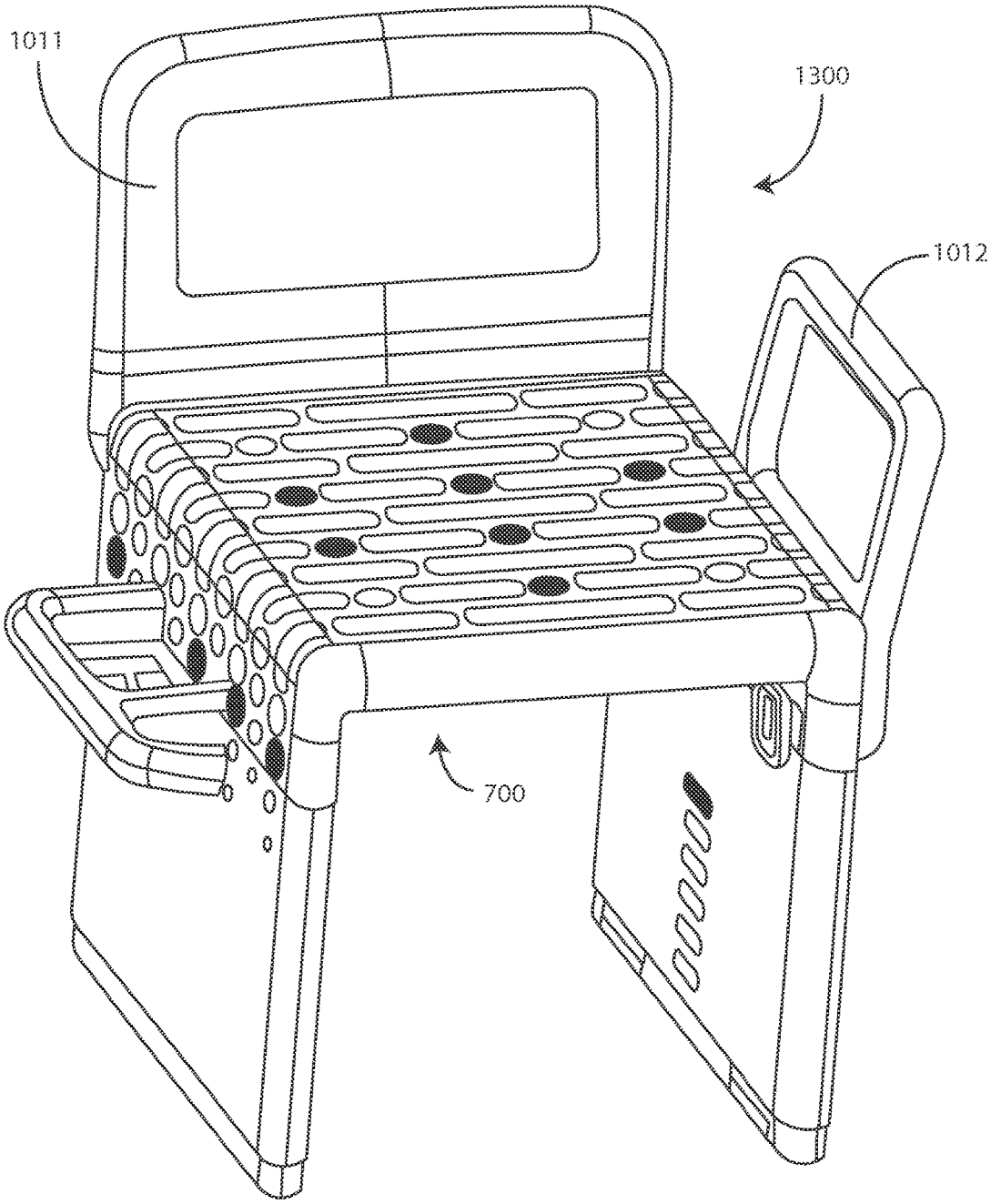
FIG. 13 illustrates another explanatory modular seating system in accordance with one or more embodiments of the disclosure.

Illustrating by example, turning now to FIG. 13, a modular system 1300 is shown that includes a bench 700. Attached to the bench 700 are a backrest 1011, an armrest 1012, and a combination soap dish and showerhead holder 1013. By contrast, turning to FIG. 14, another system 1400 is shown. In this system, a backrest 1011, a first armrest 1012, and a second armrest 1412.

Figure 14:
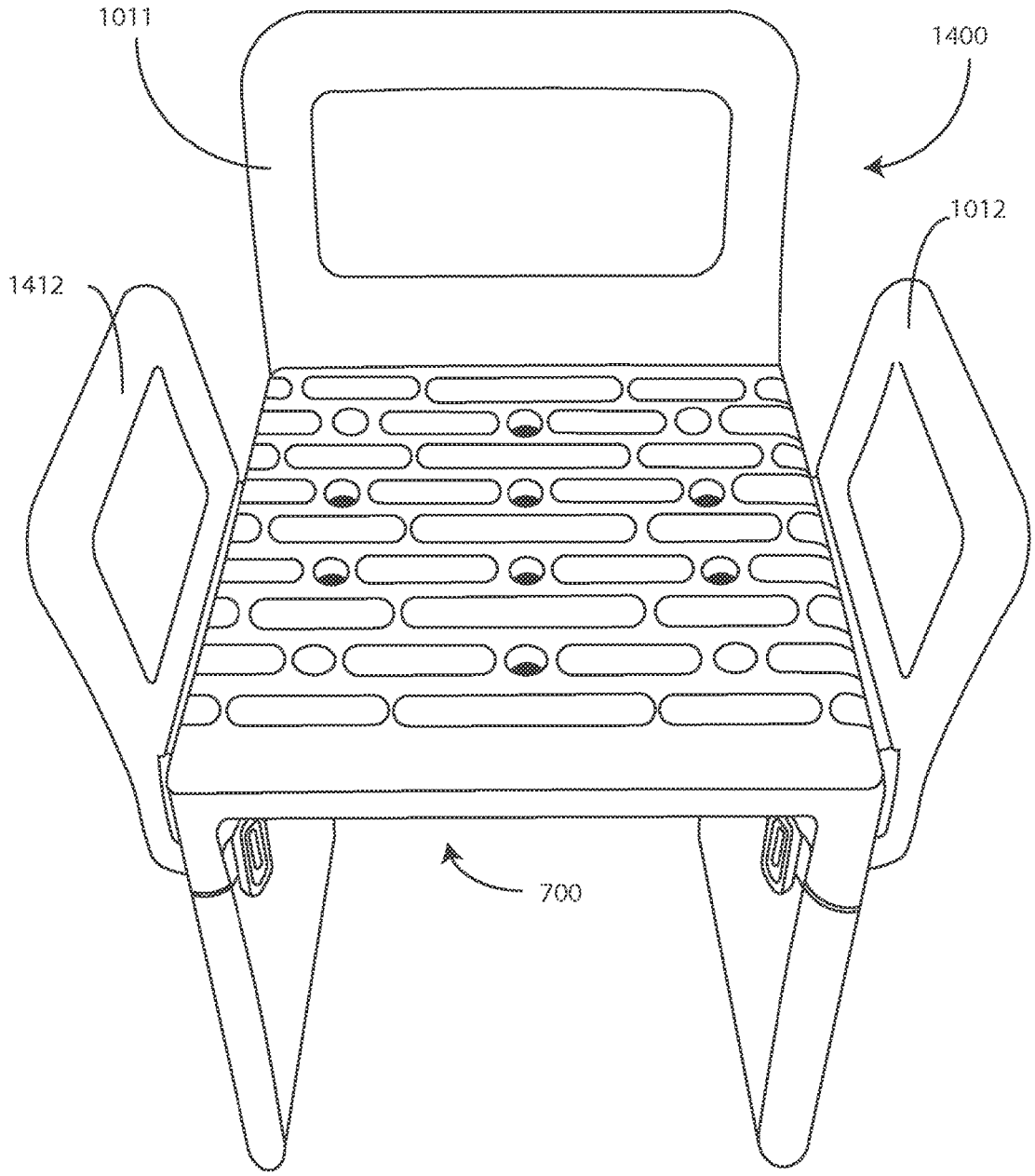
FIG. 14 illustrates another explanatory modular seating system in accordance with one or more embodiments of the disclosure.
Figure 15:
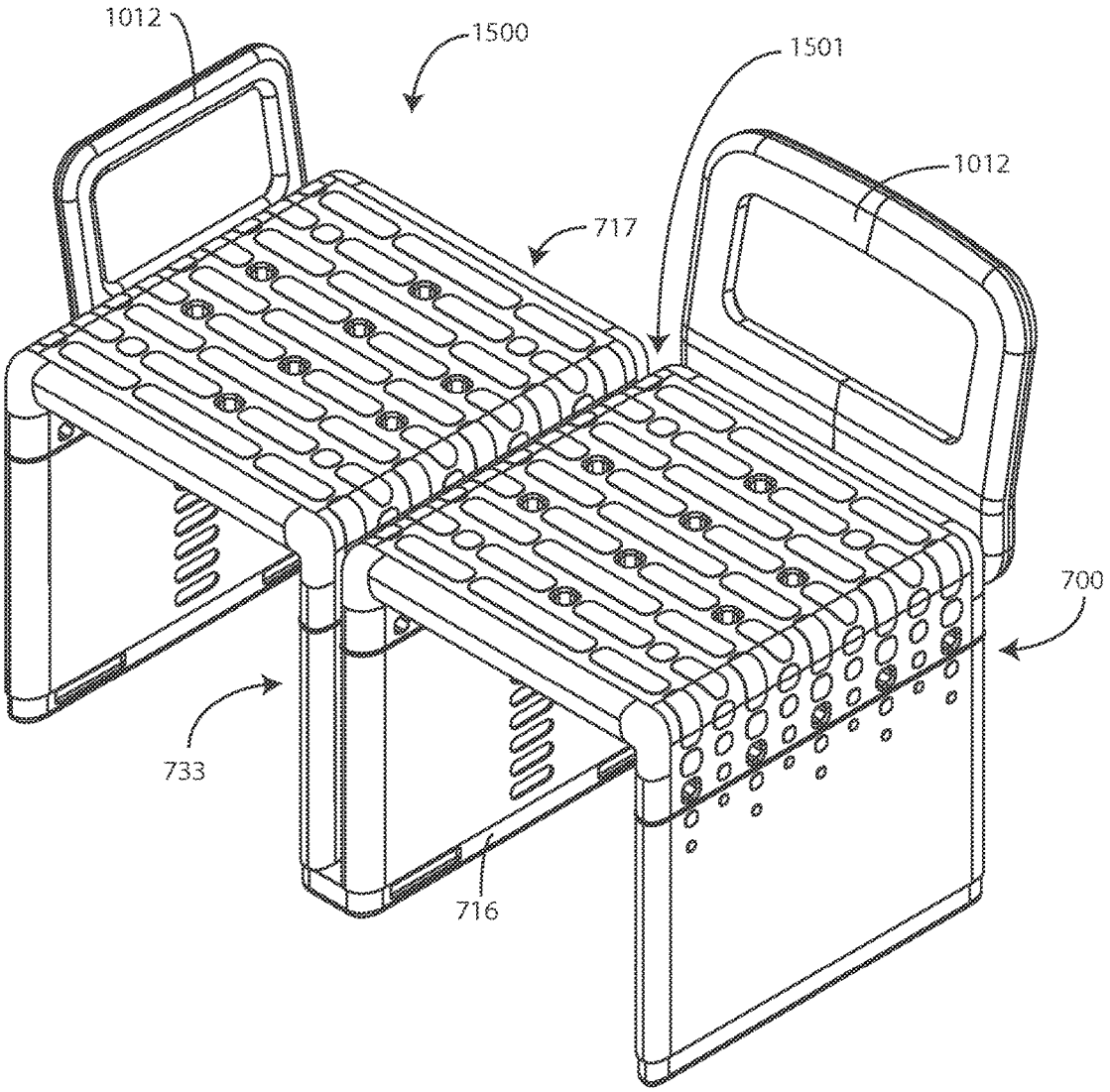
FIG. 15 illustrates another explanatory modular seating system in accordance with one or more embodiments of the disclosure.

Turning to FIG. 15, another system 1500 includes a first bench 700 and a second bench 717 coupled together by a coupler 716 to form a transfer bench 733. Here, a backrest 1011 is attached to the first bench 700, while an armrest 1012 is attached to the second bench 717. Accordingly, a user could, for example, slide from a wheelchair to the first bench 700, taking advantage of the backrest 1011. The user could then slide over to the second bench 717, taking advantage of the armrest 1012, and without needing a backrest so as to have more mobility in the shower. As previously noted, the user could simply slide a shower curtain (802) through the gap 1501 between the first bench 700 and the second bench 717 to prevent water from hitting the floor (804). FIGS. 13-15 show a few of the myriad of possible configurations that embodiments of the disclosure can take when accessories are attached. Others will be obvious to those of ordinary skill in the art having the benefit of this disclosure.

Figure 16:
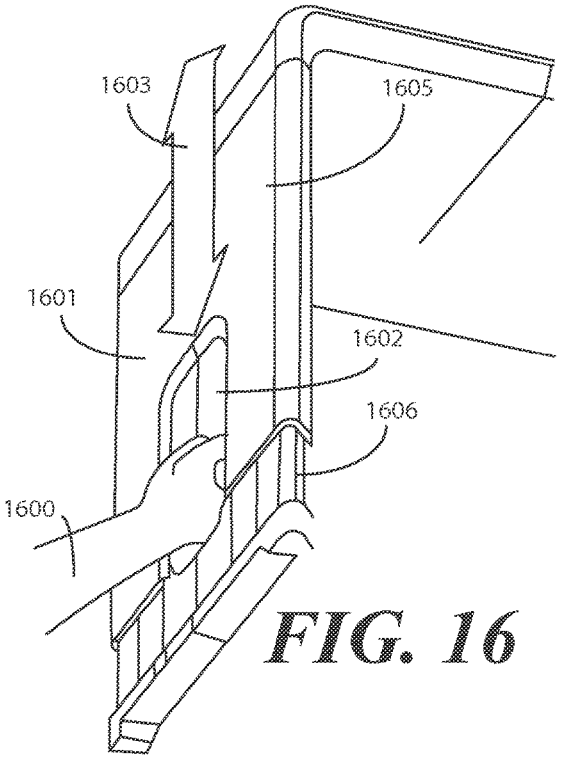
FIG. 16 illustrates another explanatory modular seating apparatus in accordance with one or more embodiments of the disclosure.
Figure 17:
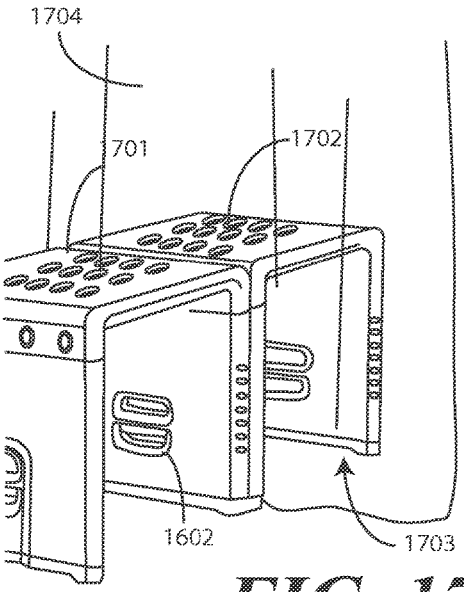
FIG. 17 illustrates yet another explanatory modular seating system in accordance with one or more embodiments of the disclosure.
Figure 18:
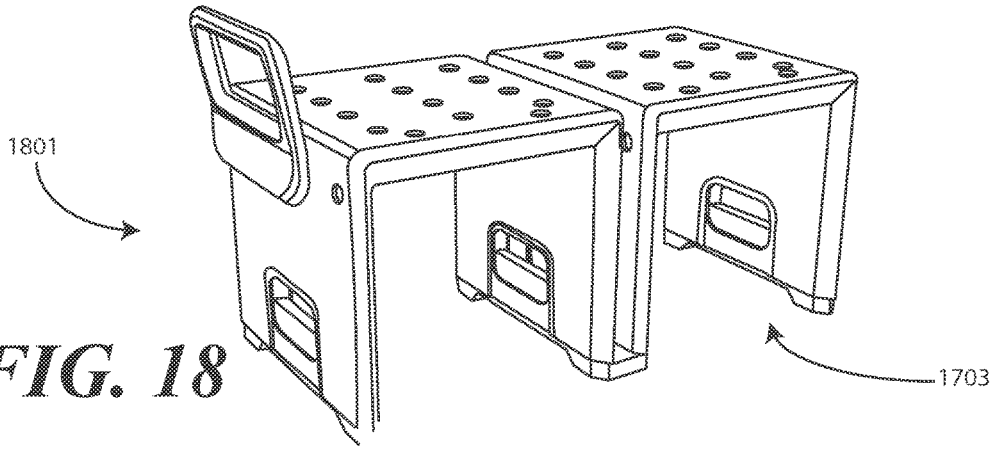
FIG. 18 illustrates yet another explanatory modular seating system in accordance with one or more embodiments of the disclosure.

Turning to FIG. 16, illustrated therein is an alternate adjustment mechanism in accordance with one or more embodiments of the disclosure. In FIG. 16, a user 1600 is shown adjusting 1603 a leg member 1601. Rather than pressing a push button (304), as was the case above with reference to FIG. 3, the user 1600 grasps a handle 1602 that retracts locking bars (not shown) from one or more apertures 1604 disposed on the side of the casing sleeve 1605 of the leg member 1601. The handle 1602 not only releases the foot insert 1606 from the casing sleeve 1605, but also provides something for the user 1600 to grasp when moving the foot insert 1606. The handle 1602 can be seen without the user's hand in FIG. 17 where two benches 1701,1702 are coupled together to form a transfer bench 1703. The transfer bench 1703 is shown with an armrest 1801 attached in FIG. 18.

To configure the two benches 1701,1702 as the transfer bench 1703, the foot insert (1606) removed and replaced with a coupler as previously described such that a first leg of one bench 1701 is coupled to another leg of another bench 1702. The coupler can be structured to insert into casing sleeves of the bench legs such that they are adjacent and parallel in one embodiment. Once coupled, the two benches 1701,1702 are prevented from separating as the user moves across the transfer bench 1703 when transferring in and out of, for example, a bathtub. The coupler additionally, in one embodiment, spaces the two legs apart by a predetermined distance to define a void between the legs to allow the shower curtain 1704 to move freely between the two benches 1701,1702 when the shower curtain 1704 is opened and closed.

Figure 19:
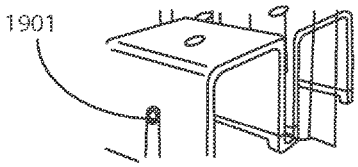
FIG. 19 illustrates yet another explanatory modular seating system in accordance with one or more embodiments of the disclosure.
Figure 20:
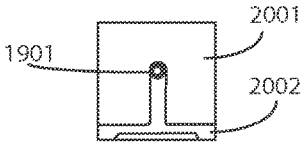
FIG. 20 illustrates another explanatory adjustment mechanism in accordance with one or more embodiments of the disclosure.
Figure 21:
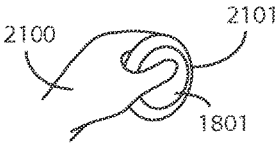
FIG. 21 illustrates a user adjusting an explanatory adjustment mechanism in accordance with one or more embodiments of the disclosure.

Turning to FIGS. 19-21, illustrated therein is still another attachment mechanism. Here, the attachment mechanism is configured as an exterior push button 1901. The exterior push button 1901 works in a similar fashion to the push button (304) of FIG. 3 in one embodiment. However, it provides a different aesthetic appearance and offers a different area of access. A user 2100 is shown actuating the push button 1901 in FIG. 21. As will be apparent to those of ordinary skill in the art having the benefit of this disclosure, a mechanical linking system could be coupled to the push button 1901 to retract locking bars from apertures in the side of the casing sleeve as described above with reference to FIG. 16.

In one or more embodiments, the foot insert 2002 can be selectively raised and lowered within the casing sleeve 2001 to change the height of a leg member to accommodate the user's needs. As shown in FIG. 21, the user 2100 simply presses the push button 1901 into the aperture 2101 through which it protrudes to allow the foot insert 2002 to slide up or down as desired. In one or more embodiments the push button 1901 comprises an oversized button to increase visual and tactile usability. In one embodiment, each of the push button 1901, the foot insert 2002, and the casing sleeve 2001 are all color matched for a streamlined and consistent aesthetic.

Figure 22:
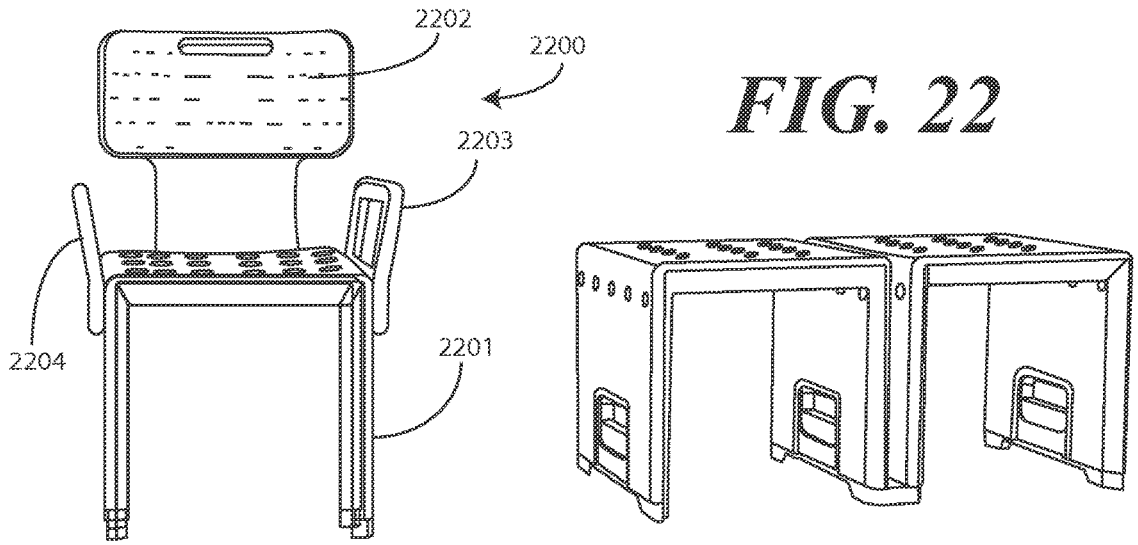
FIG. 22 illustrates another explanatory modular seating apparatus in accordance with one or more embodiments of the disclosure.
Figure 23:
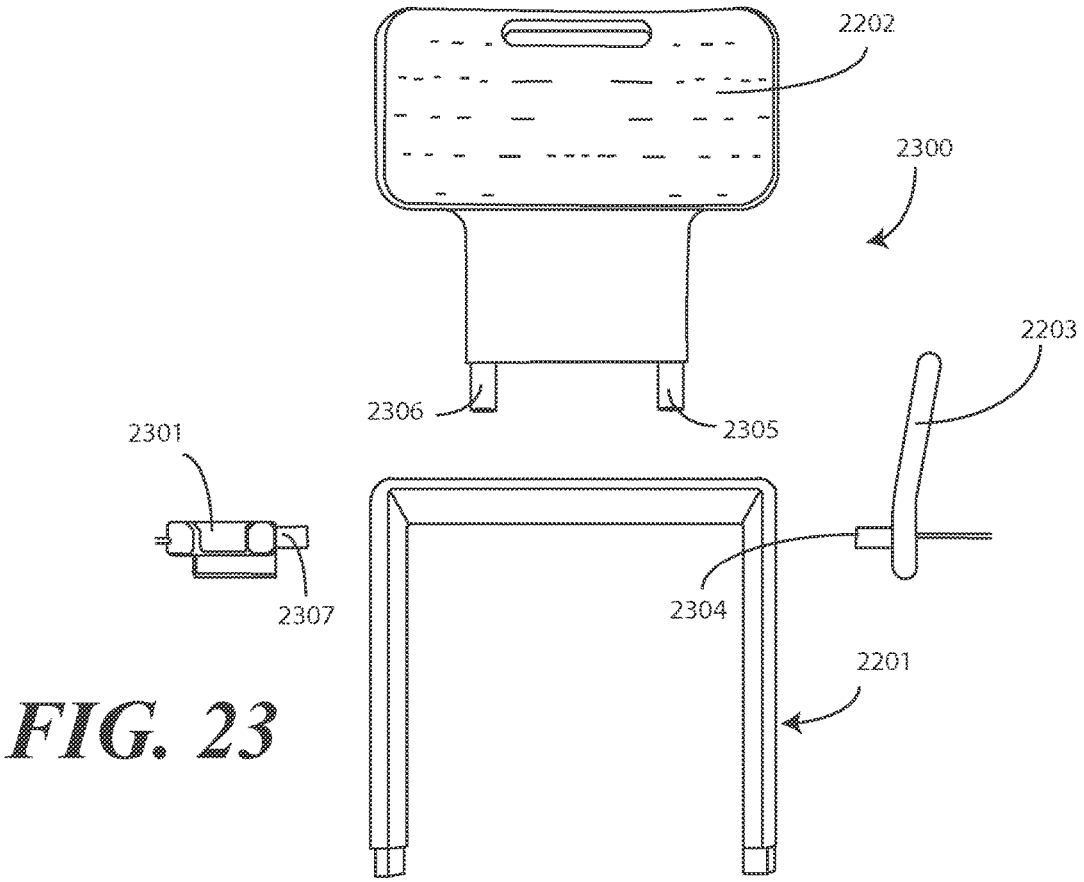
FIG. 23 illustrates another modular seating apparatus in accordance with one or more embodiments of the disclosure.

Turning now to FIGS. 22-23, illustrated therein is an alternate modular seating apparatus 2200,2300 in accordance with one or more embodiments of the disclosure. In this explanatory embodiment, the modular seating apparatus 2200,2300 has, as its base component, a bench 2201. However, in this embodiment a chair back 2202 is attached to the bench 2201 so that the modular seating apparatus 2200,2300 becomes configured as a chair. Other seating configurations will be obvious to those of ordinary skill having the benefit of this disclosure. As shown in FIG. 22, two armrests 2203,2204 can be attached to configure the modular seating apparatus 2200 as an armchair.

Alternatively, as shown in FIG. 23, a single armrest 2203 and a soap dish and/or shower head holder 2301 to configure the modular seating apparatus 2300 as a bath chair. Note that the modular seating apparatus 2200 of FIG. 22 is shown assembled, while the modular seating apparatus 2300 of FIG. 23 is shown in an exploded view to illustrate attachment mechanisms 2304,2305,2306,2307 by which the chair back 2202, armrest 22203, and soap dish and/or shower head holder 2301 attach to the bench 2201. As with previous modular seating devices, the bench 2201 can include multiple apertures that allow water to flow through the bench 2201. These apertures can also provide insertion points for the attachment mechanisms 2304,2305,2306,2307 by which the chair back 2202, armrest 22203, and soap dish and/or shower head holder 2301 attach to the bench 2201. In one embodiment, the apertures are placed throughout the top and side surfaces of the bench 2201 to allow for the armrest 2203, and soap dish and/or shower head holder 2301 attach to the bench 2201 to be placed at different locations to suit the user's preferences.

Embodiments of the disclosure provide a transfer bench that is easy for a user to slide on, and that can be used to slide into, and out of, a bathtub. Moreover, the transfer bench does not interfere with any shower curtain, thereby preventing water from splashing outside the bathtub, yet while maintaining the necessary stability to support the user. While numerous utilitarian features of various modular seating apparatuses configured in accordance with one or more embodiments of the disclosure have been described above, it should be noted that each modular seating apparatus has associated therewith a multitude of ornamental design features as well. To be sure, some of the elements associated with embodiments of the disclosure provide both functional and ornamental design features.

One example of this is the textured surface (111) shown in FIG. 1. Not only does this textured surface (111) provide a friction-increasing surface for the user, it also provides a unique aesthetic that identifies a particular ornamental design that is recognizable to the user. Similarly, the stylistic accessories can attach to the bench base of seating apparatuses to provide a very unique ornamental design as well.

Turning now to FIGS. 24-31, illustrated therein are ornamental design elements of one explanatory bench 2400 configured in accordance with one or more embodiments of the disclosure. The bench 2400 of FIGS. 24-31 is shown with a backrest 2401 to form an armless chair. Of course, other attachments could be added as previously described. Still other attachments will be obvious to those of ordinary skill in the art.

Figure 24:
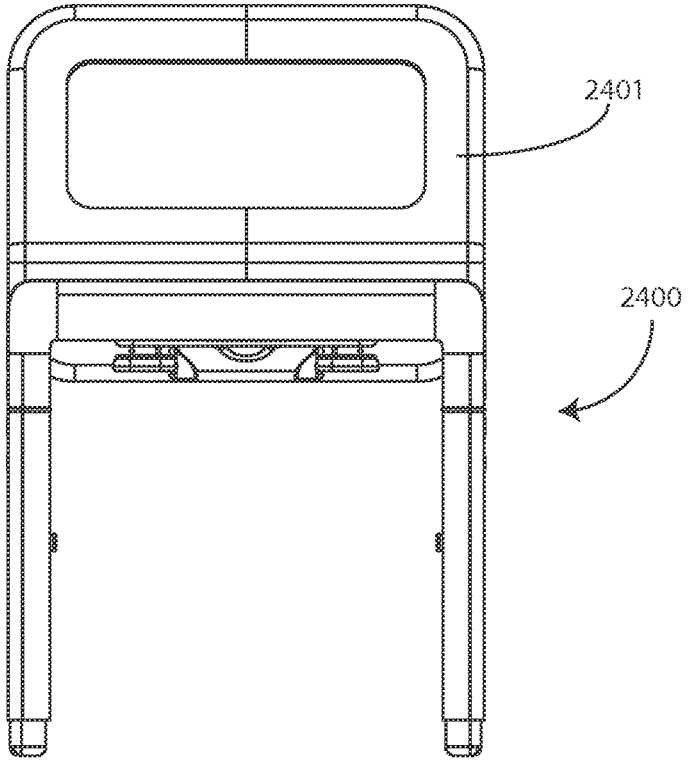
FIG. 24 illustrates an ornamental appearance of one modular seating apparatus, shown in a front elevation view, in accordance with one or more embodiments of the disclosure.
Figure 25:
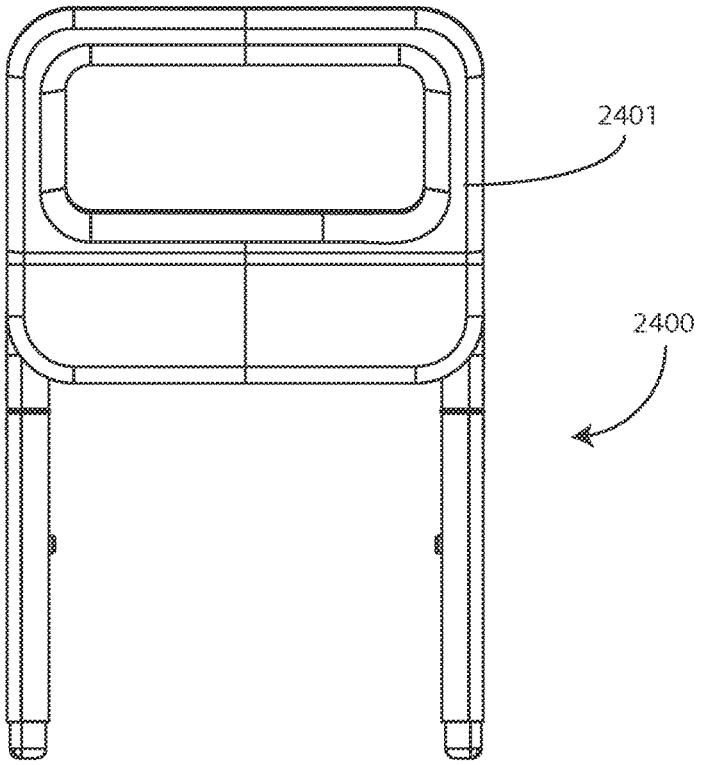
FIG. 25 illustrates an ornamental appearance of one modular seating apparatus, shown in a rear elevation view, in accordance with one or more embodiments of the disclosure.
Figure 26:
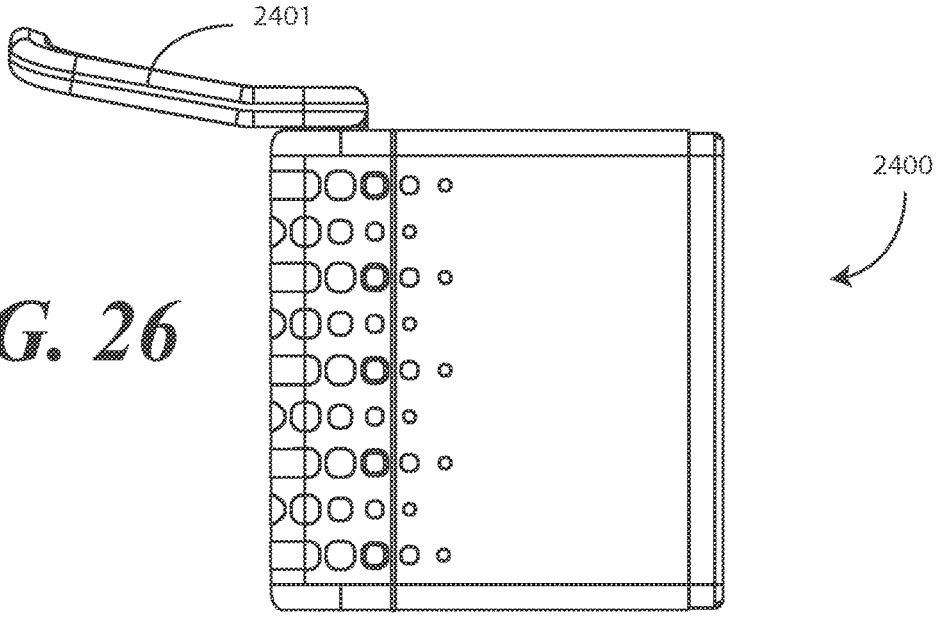
FIG. 26 illustrates an ornamental appearance of one modular seating apparatus, shown in a left elevation view, in accordance with one or more embodiments of the disclosure.
Figure 27:
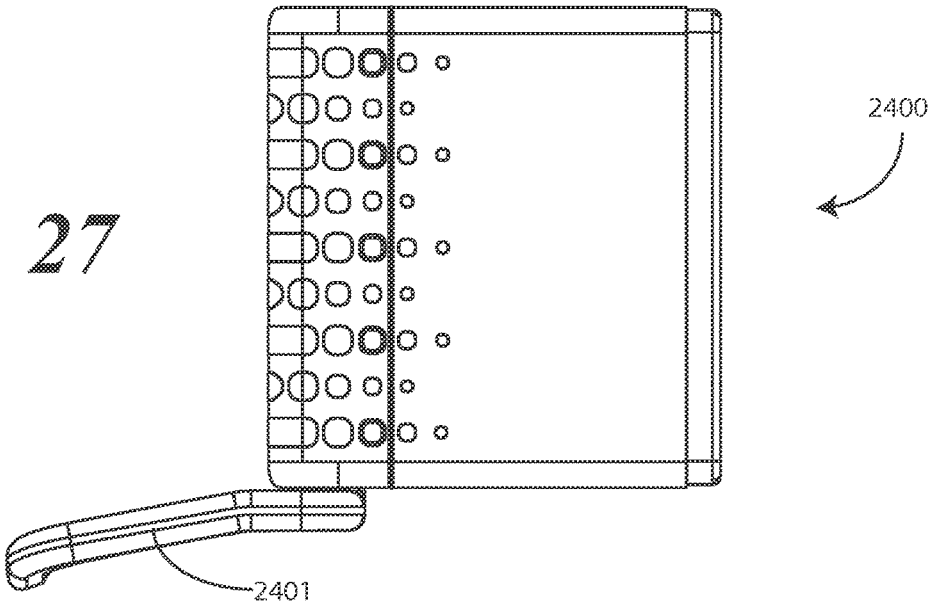
FIG. 27 illustrates an ornamental appearance of one modular seating apparatus, shown in a right elevation view, in accordance with one or more embodiments of the disclosure.
Figure 28:
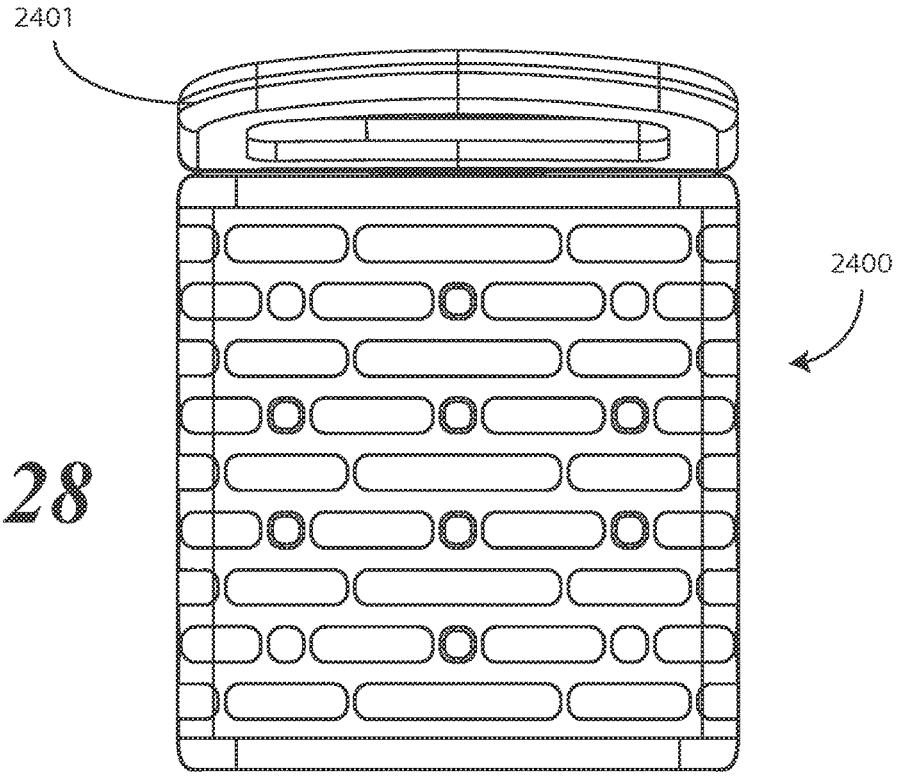
FIG. 28 illustrates an ornamental appearance of one modular seating apparatus, shown in a top plan view, in accordance with one or more embodiments of the disclosure.
Figure 29:
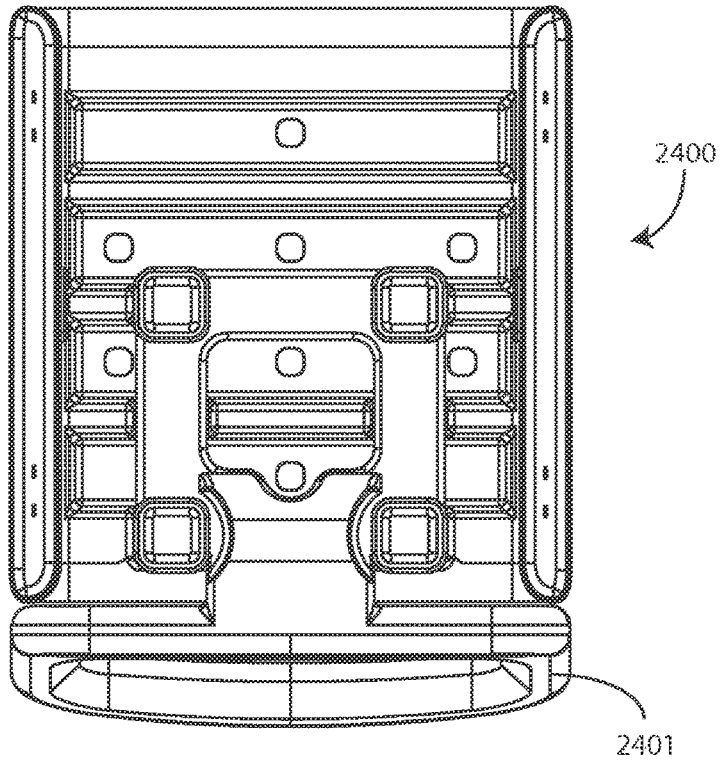
FIG. 29 illustrates an ornamental appearance of one modular seating apparatus, shown in a bottom plan view, in accordance with one or more embodiments of the disclosure.
Figure 30:
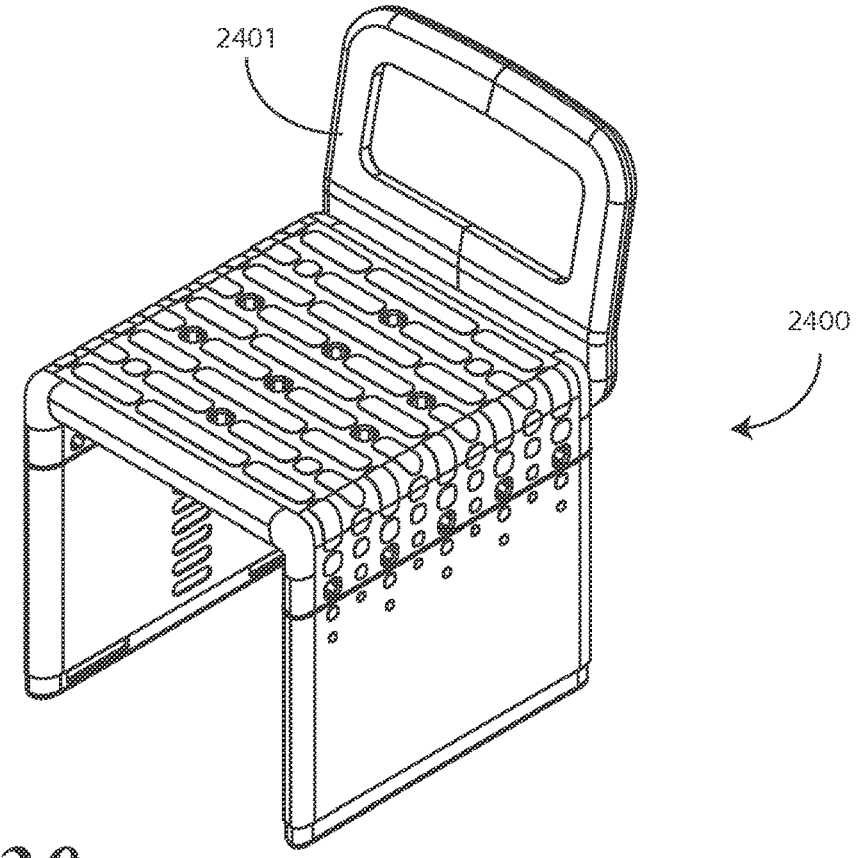
FIG. 30 illustrates an ornamental appearance of one modular seating apparatus, shown in a perspective view, in accordance with one or more embodiments of the disclosure.
Figure 31:
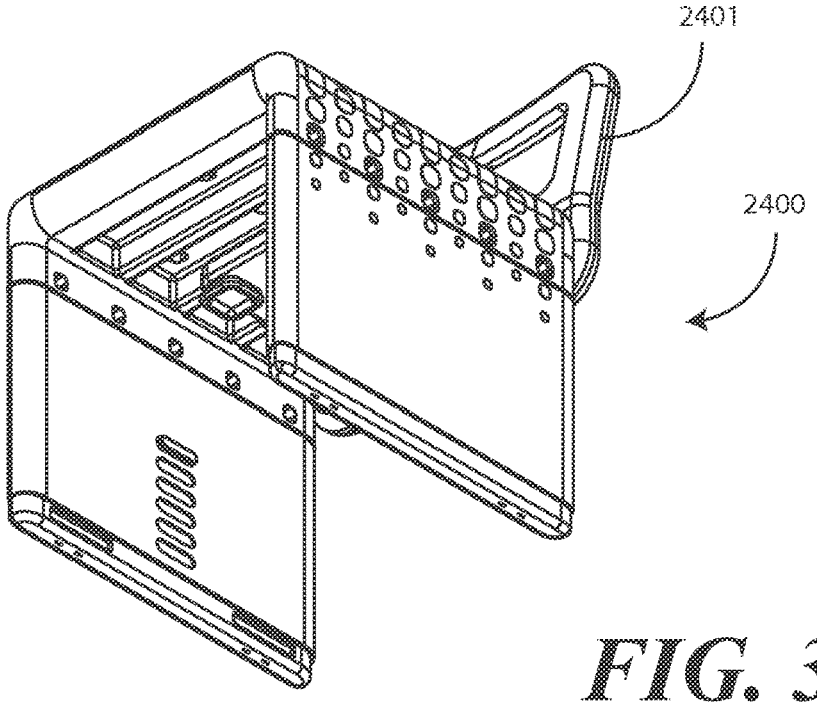
FIG. 31 illustrates an ornamental appearance of one modular seating apparatus, shown in another perspective view, in accordance with one or more embodiments of the disclosure.

FIG. 24 illustrates a front elevation view of the bench 2400 showing one explanatory ornamental design of the bench 2400 in accordance with one or more embodiments of the disclosure, while FIG. 25 illustrates a rear elevation view of the bench 2400. FIG. 26 illustrates a left elevation view of the bench 2400, while FIG. 27 illustrates a right elevation view of the bench 2400. FIG. 28 illustrates a top, plan view of the bench 2400, while FIG. 29 illustrates a bottom, plan view of the bench 2400. FIG. 30 illustrates a first perspective view of the bench 2400, while FIG. 31 illustrates a second, perspective view of the bench 2400.

At the most basic level, the ornamental design associated with the explanatory embodiment of the bench 2400 shown in FIGS. 24-31 is compelling due to of its simple geometry. This form includes a support platform that spans between the two legs to provide a large landing zone for the user during transfers and showering alike.

Turning now to FIGS. 32-39, illustrated therein are ornamental design elements of one explanatory transfer bench 3200 configured in accordance with one or more embodiments of the disclosure. The transfer bench 3200 of FIGS. 32-39 is shown with a backrest 3201 attached to a first bench 3202, and an armrest 3204 attached to a second bench 3203. Of course, other attachments could be added as previously described. Still other attachments will be obvious to those of ordinary skill in the art.

Figure 32:
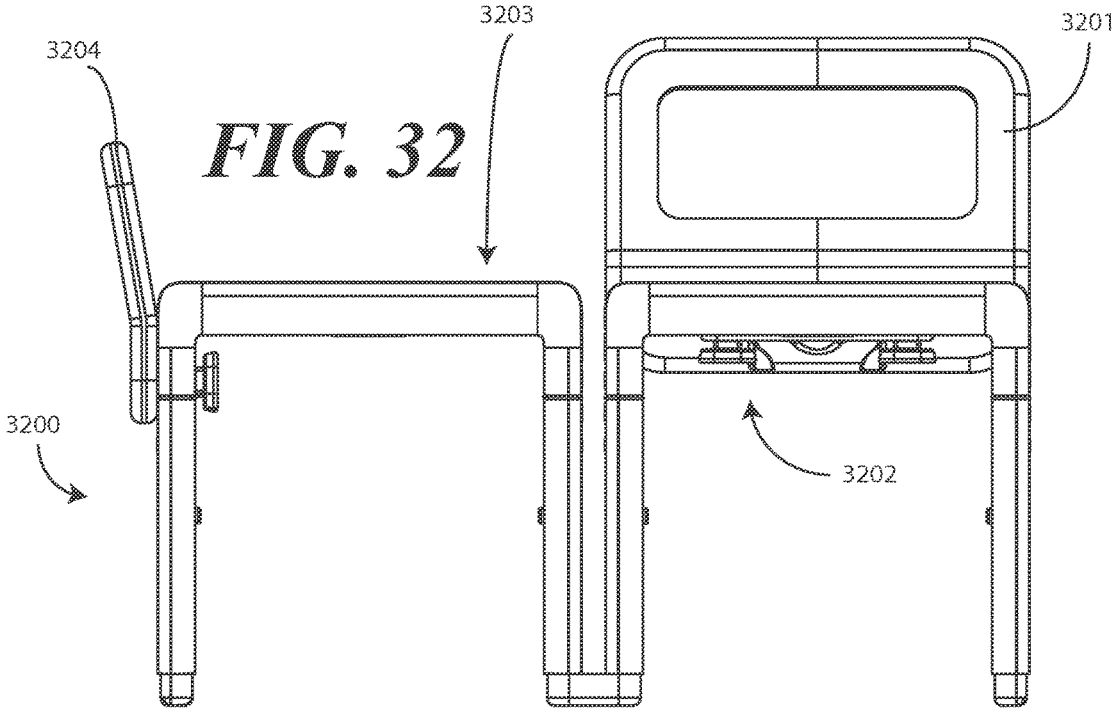
FIG. 32 illustrates an ornamental appearance of another modular seating apparatus, shown in a front elevation view, in accordance with one or more embodiments of the disclosure.
Figure 33:
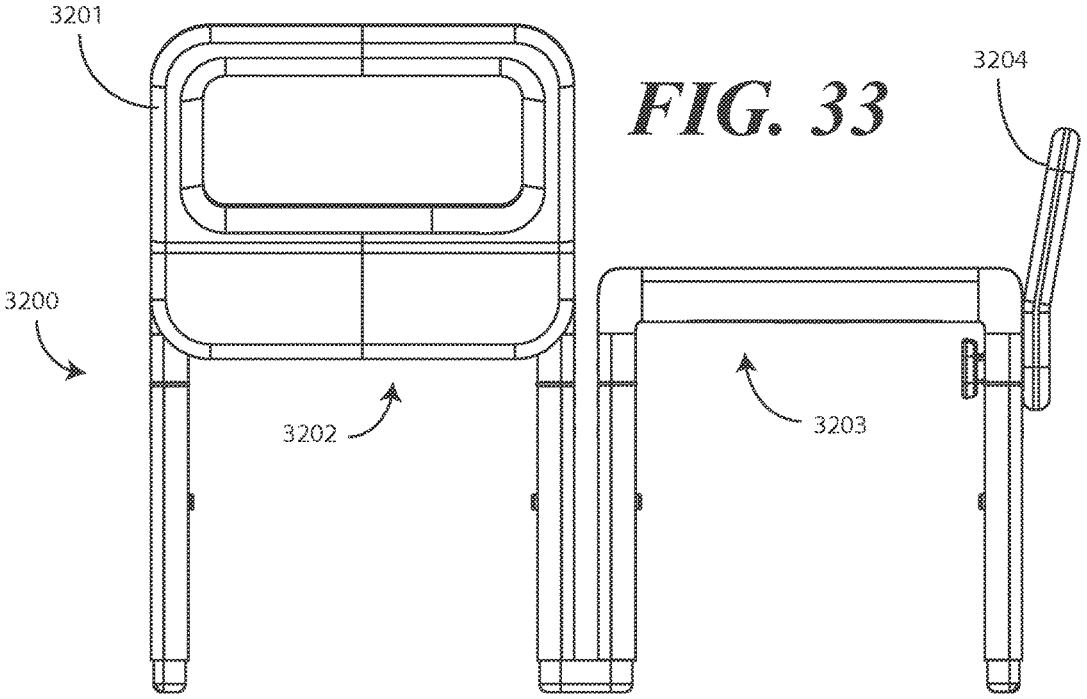
FIG. 33 illustrates an ornamental appearance of another modular seating apparatus, shown in a rear elevation view, in accordance with one or more embodiments of the disclosure.
Figure 34:
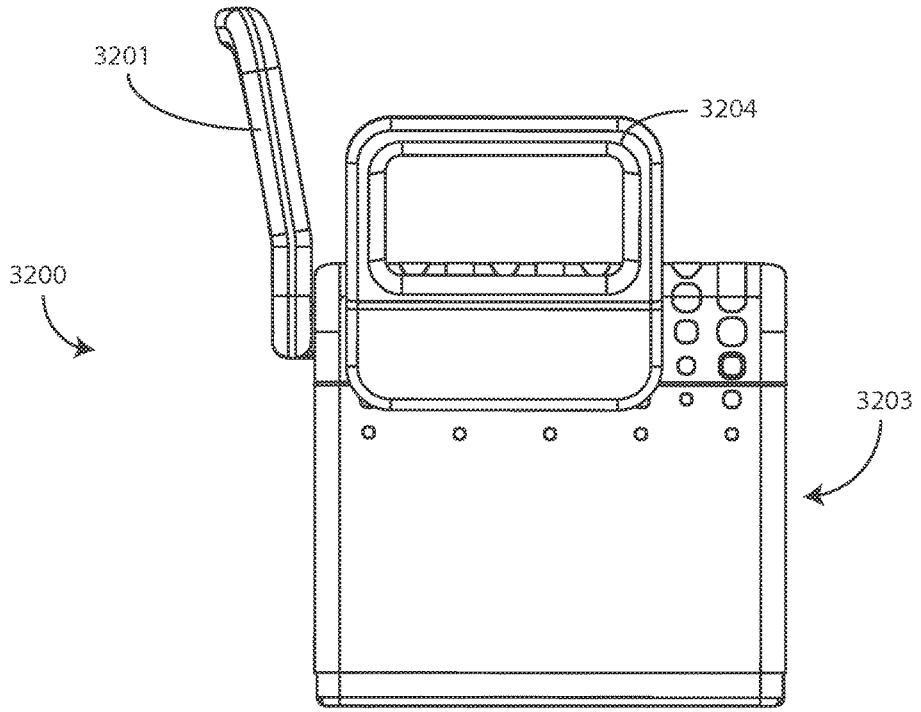
FIG. 34 illustrates an ornamental appearance of another modular seating apparatus, shown in a right elevation view, in accordance with one or more embodiments of the disclosure.
Figure 35:
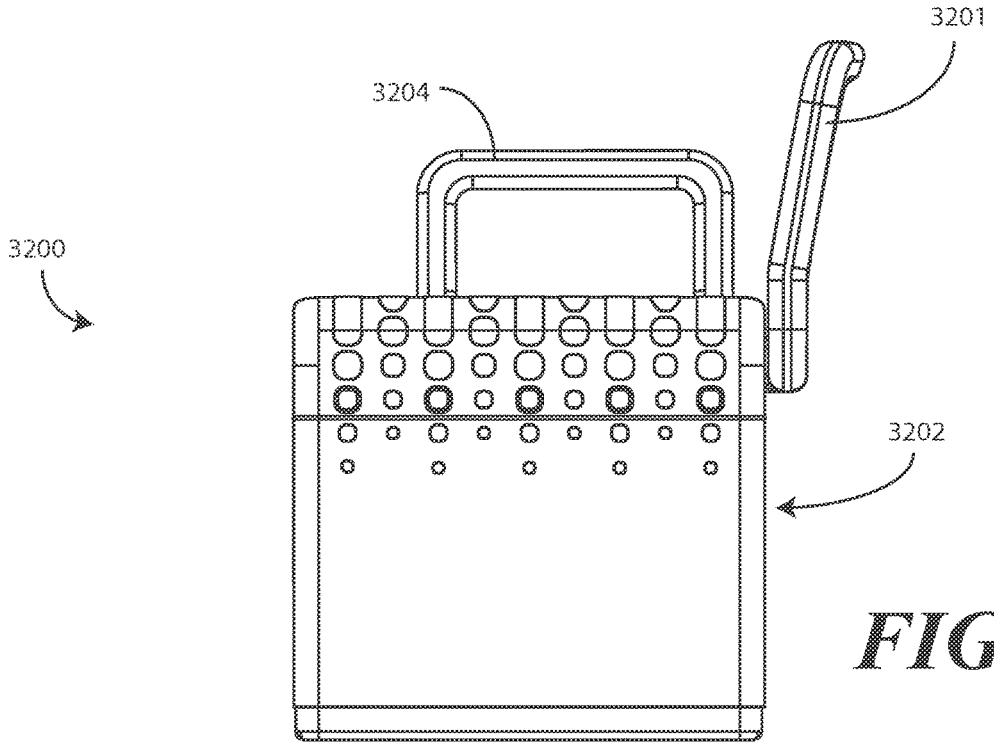
FIG. 35 illustrates an ornamental appearance of another modular seating apparatus, shown in a left elevation view, in accordance with one or more embodiments of the disclosure.
Figure 36:
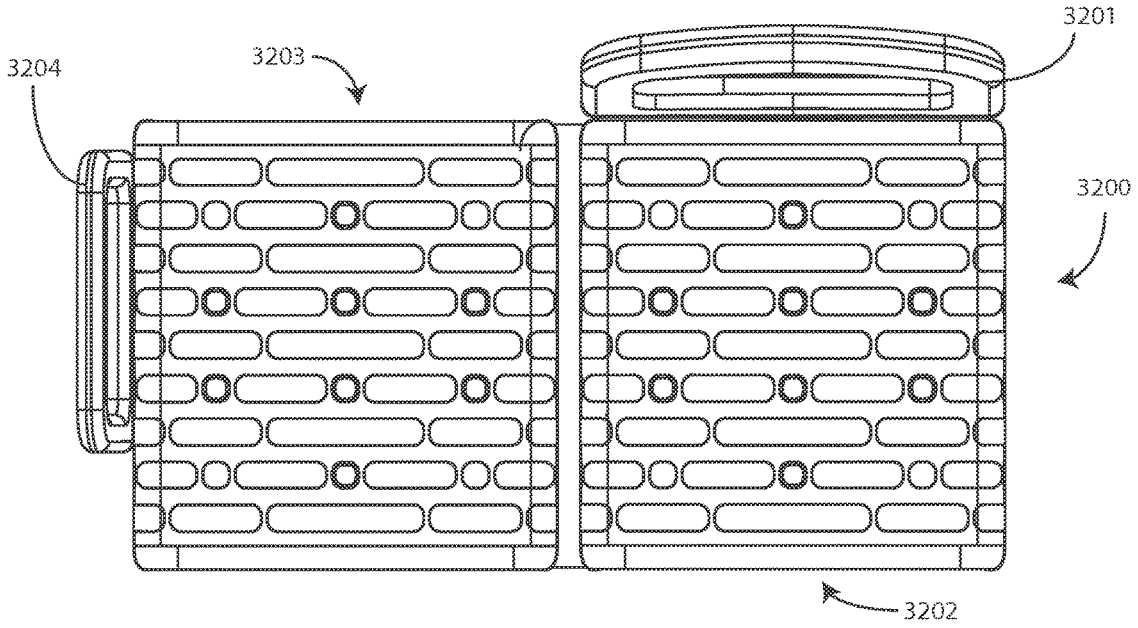
FIG. 36 illustrates an ornamental appearance of another modular seating apparatus, shown in a top plan view, in accordance with one or more embodiments of the disclosure.
Figure 37:
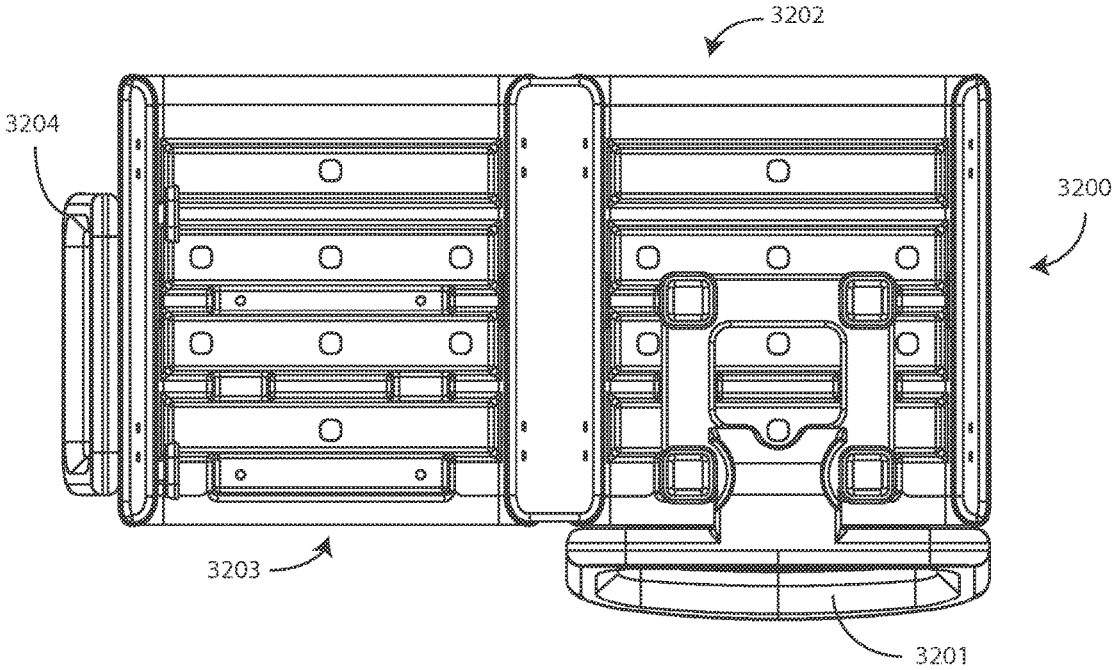
FIG. 37 illustrates an ornamental appearance of another modular seating apparatus, shown in a bottom plan view, in accordance with one or more embodiments of the disclosure.
Figure 38:
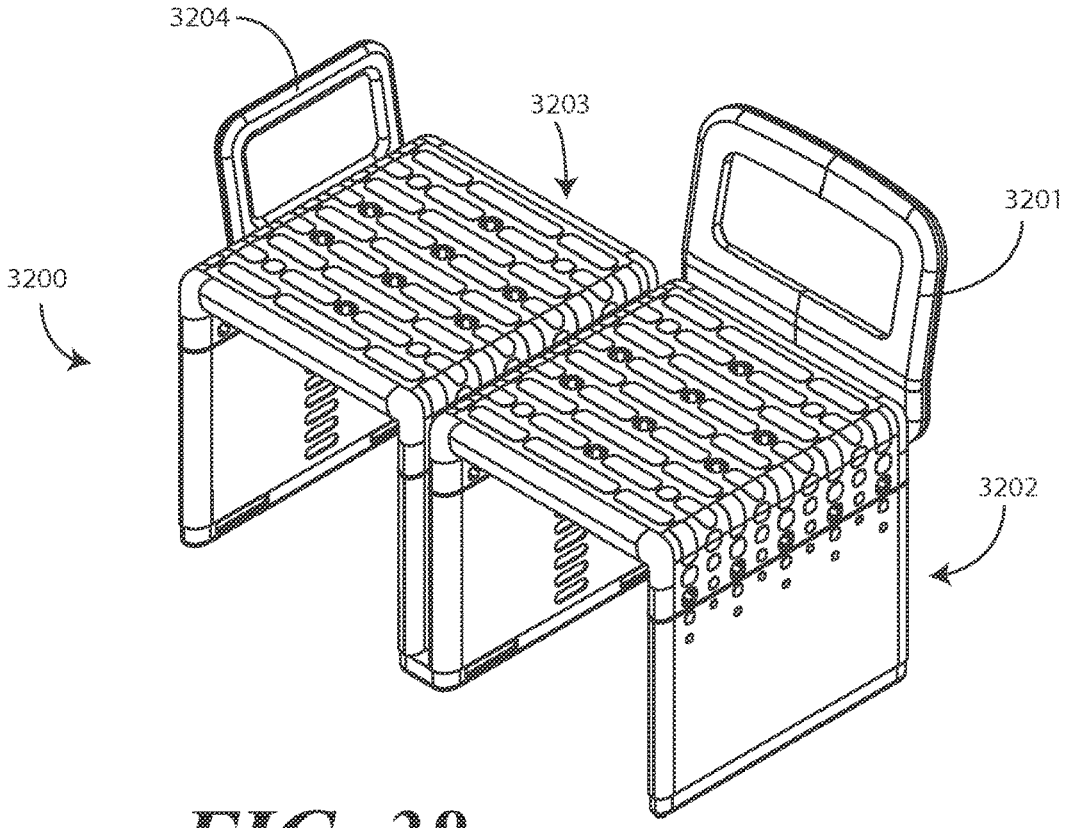
FIG. 38 illustrates an ornamental appearance of another modular seating apparatus, shown in a perspective view, in accordance with one or more embodiments of the disclosure.
Figure 39:
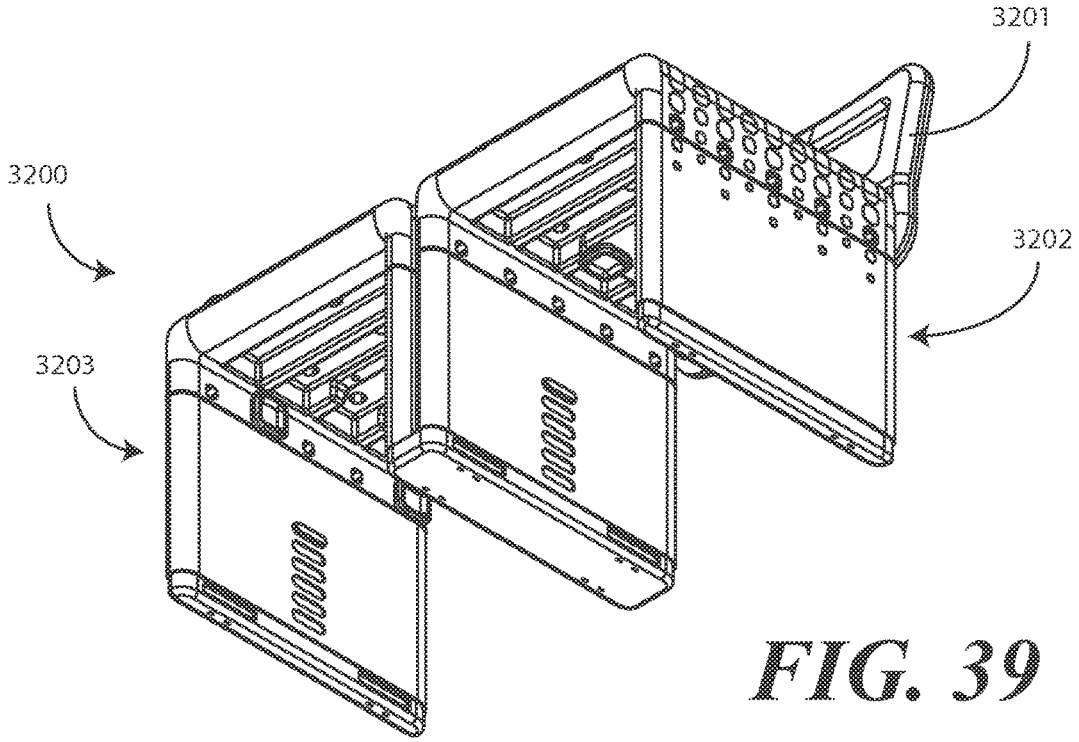
FIG. 39 illustrates an ornamental appearance of another modular seating apparatus, shown in another perspective view, in accordance with one or more embodiments of the disclosure.

FIG. 32 illustrates a front elevation view of the transfer bench 3200 showing one explanatory ornamental design of the transfer bench 3200 in accordance with one or more embodiments of the disclosure, while FIG. 33 illustrates a rear elevation view of the transfer bench 3200. FIG. 34 illustrates a right elevation view of the transfer bench 3400, while FIG. 35 illustrates a left elevation view of the transfer bench 3200. FIG. 36 illustrates a top, plan view of the transfer bench 3200, while FIG. 37 illustrates a bottom, plan view of the transfer bench 3200. FIG. 38 illustrates a first perspective view of the transfer bench 3200, while FIG. 39 illustrates a second, perspective view of the transfer bench 3200.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A bench, comprising:

an upper member comprising:

a substantially planar portion;

a first side end portion; and a second side end portion;

the substantially planar portion defining a seat;

the first side end portion extending substantially orthogonally from the seat along a first side of the seat; and the second side end portion extending substantially orthogonally from the seat along a second side of the seat;

the second side of the seat located distally opposite the seat from the first side end portion;

the seat defining a seat width and a seat length;

the first side end portion and the second side end portion defining a side end portion length and a side end portion width; and the seat length coextensive with the side end portion length;

a first leg member, selectively attachable with at least a first boss extending from the first leg member to an end of the first side end portion, and defining a first leg member length that is coextensive with the side end portion length; and a second leg member, selectively attachable with at least a second boss extending from the second leg member to an end of the second side end portion, and defining a second leg member length that is coextensive with the side end portion length;

one or both of the first leg member or the second leg member comprising and adjustment mechanism to selectively alter a height of the one or both of the first leg member or the second leg member.

2. The bench of claim 1, the seat comprising:

a textured surface disposed along a first major face of the seat; and one or more apertures disposed along the seat to allow water to flow therethrough.

3. The bench of claim 2, the seat further comprising one or more support ribs disposed along a second major face of the seat.

4. The bench of claim 1, the upper member defining one or more threaded apertures, further comprising:

a bench accessory; and one or more threaded retention devices to couple the bench accessory to the upper member by engaging the one or more threaded apertures.

5. The bench of claim 4, the bench accessory comprising a backrest.

6. The bench of claim 4, the bench accessory comprising an armrest.

7. The bench of claim 4, the bench accessory comprising a combination soap dish and shower head holder.

8. The bench of claim 4, the one or more threaded retention devices each comprising a handle to enable toolless rotation of the one or more threaded retention devices in the one or more threaded apertures to couple the accessory to the upper member.

9. The bench of claim 8, the handle defining a square cross section.

10. The bench of claim 1, the adjustment mechanism comprising a push button to selectively protrude through one aperture of a plurality of apertures disposed along a sidewall of the one or both of the first leg member or the second leg member.

11. The bench of claim 10, the one or both of the first leg member or the second leg member comprising:

a casing sleeve; and a foot insert disposed within the casing sleeve; and a compressible biasing device;

the compressible biasing device disposed between the push button and the foot insert to apply a preloading force biasing the push button away from the foot insert and through the one aperture.

12. The bench of claim 11, the casing sleeve defining an ovular cross section, the first boss and the second boss defining another ovular cross section, the ovular cross section larger than the another ovular cross section.

13. The bench of claim 12, the first leg member further comprising a snap mechanism to retain the first leg member to the first side end portion when the at least a first boss is inserted into the end of the first side end portion.

14. The bench of claim 13, the foot insert comprising a rubber grip foot disposed at an end of the foot insert.

15. The bench of claim 11, the foot insert selectively removable from the casing sleeve.

16. The bench of claim 15, further comprising a coupler to insert into the casing sleeve, the coupler to attach the bench to another bench.

17. The bench of claim 16, the coupler comprising:

a footer;

a first side section; and a second side section;

the first side section extending substantially orthogonally from a first end of the footer, the second side section extending substantially orthogonally from a second end of the footer.

18. The bench of claim 17, the footer having a width of at least two inches to allow a shower curtain to pass between the bench and the another bench when coupled together by the coupler.

19. A bench assembly, comprising:

a first bench comprising:

a first upper member defining a seat, a first side end portion, and a second side end portion, the first side end portion and the second side end portion extending distally from a first end of the seat and a second end of the seat, respectively;

a first leg member attached to the first side end portion and having a first major dimension that is coextensive with a major dimension of the first side end portion;

a second leg member attached to the second side end portion and also having the first major dimension;

a second bench comprising:

a second upper member defining a second seat, a third side end portion, and a fourth side end portion, the third side end portion and the fourth side end portion extending distally from ends of the second seat, respectively;

a third leg member attached to the third side end portion;

a fourth leg member attached to the fourth side end portion; and a coupler attaching a terminal end of one of the first leg member or the second leg member to another terminal end of one of the third leg member or the fourth leg member;

the coupler having a width sufficient for a shower curtain to pass between the first bench and the second bench when the coupler is attached to the terminal end of the one of the first leg member or the second leg member and the another terminal end of the one of the third leg member or the fourth leg member.

20. The bench assembly of claim 19, further comprising:

at least one bench accessory; and one or more threaded retention devices to couple the at least one bench accessory to one of the first bench or the second bench;

the one or more threaded retention devices each comprising a handle to enable tool-less attachment of the at least one bench accessory to the one of the first bench or the second bench.

* * * * *